US009875643B1

(12) United States Patent
Sarna, II

(10) Patent No.: US 9,875,643 B1
(45) Date of Patent: Jan. 23, 2018

(54) SYSTEMS AND METHODS OF EMERGENCY MANAGEMENT INVOLVING LOCATION-BASED FEATURES AND/OR OTHER ASPECTS

(71) Applicant: SHOTSPOTTER, INC., Newark, CA (US)

(72) Inventor: Peter C. Sarna, II, Mountain View, CA (US)

(73) Assignee: SHOTSPOTTER, INC., Newark, CA (US)

( * ) Notice: Subject to any disclaimer, the term of this patent is extended or adjusted under 35 U.S.C. 154(b) by 307 days.

(21) Appl. No.: 14/538,757

(22) Filed: Nov. 11, 2014

Related U.S. Application Data

(60) Provisional application No. 61/902,756, filed on Nov. 11, 2013.

(51) Int. Cl.
*G08B 1/00* (2006.01)
*G08B 25/10* (2006.01)
*G08B 21/18* (2006.01)

(52) U.S. Cl.
CPC ..... *G08B 25/10* (2013.01); *G08B 21/18* (2013.01)

(58) Field of Classification Search
CPC ..... G08B 25/10; G08B 21/18
USPC ..... 340/539.1, 539.11, 539.13
See application file for complete search history.

(56) References Cited

U.S. PATENT DOCUMENTS 5,973,998 A 10/1999 Showen et al.
6,621,764 B1 9/2003 Smith
7,109,859 B2 9/2006 Peeters
7,423,934 B1 9/2008 Uzes
7,518,504 B2 4/2009 Peeters
7,586,812 B2 9/2009 Baxter et al.
7,796,470 B1 9/2010 Lauder et al.
(Continued)

FOREIGN PATENT DOCUMENTS

EP 1806952 A2 7/2007
EP 2046040 A2 4/2009
EP 2439708 A1 4/2012

OTHER PUBLICATIONS

European Search Report received in counterpart EP patent application No. 14779333.5, dated Dec. 9, 2016; 11 pages.
(Continued)

*Primary Examiner* — Daryl Pope
(74) *Attorney, Agent, or Firm* — Knobbe, Martens, Olson & Bear LLP

(57) ABSTRACT

System and methods are disclosed for emergency management during threatening events such as gunfire incidents. In some exemplary implementations, systems and methods may provide information to computer-based and mobile-device user interfaces, enabling various features and capabilities such as notifying site-based subscribers and public safety personnel that an emergency has occurred at a specific location. Implementations may also provide users with real-time information that can utilized by on-site personnel and responding public safety personnel to mitigate the emergency. Further, aspects may include configurations and/or capabilities that integrate with external technology platforms such as computer aided dispatch systems, surveillance camera systems, and security systems such as those having electronic lock control.

26 Claims, 27 Drawing Sheets

(56) References Cited

U.S. PATENT DOCUMENTS

| | | | | |
|---|---|---|---|---|
| 7,844,248 | B2 | 11/2010 | Sotack | |
| 7,855,935 | B1 * | 12/2010 | Lauder | G01S 3/80 367/127 |
| 8,421,015 | B1 | 4/2013 | Scott et al. | |
| 2002/0003470 | A1 | 1/2002 | Auerbach | |
| 2004/0100868 | A1 | 5/2004 | Patterson et al. | |
| 2005/0001720 | A1 | 1/2005 | Mason et al. | |
| 2009/0028347 | A1 | 1/2009 | Duraiswami et al. | |
| 2009/0058630 | A1 | 3/2009 | Friar et al. | |
| 2010/0245582 | A1 | 9/2010 | Harel | |
| 2012/0229275 | A1 | 9/2012 | Mattern | |

OTHER PUBLICATIONS

International Search Report, Written Opinion, and Transmittal in related PCT patent application No. PCT/US2014/032428, dated Oct. 27, 2014 (12 pgs.).

"Invitation to Pay Additional Fees and, Where Applicable, Protest Fee," in related PCT patent application No. PCT/US2014/032428, dated Aug. 5, 2014 (2 pgs.).

PCT International Search Report and Written Opinion dated Dec. 5, 2008, from PCT application PCT/US08/78840 (related to the cited '935 reference); 9 pages.

* cited by examiner

SYSTEMS AND METHODS OF EMERGENCY MANAGEMENT INVOLVING LOCATION-BASED FEATURES AND/OR OTHER ASPECTS

CROSS-REFERENCE TO RELATED APPLICATION INFORMATION

This application claims benefit/priority of provisional application No. 61/902,756, filed Nov. 11, 2013, which is incorporated herein by reference in entirety.

BACKGROUND

Field

Aspects of the present innovations relate generally to emergency notification systems and more specifically to a system and method for notifying site-based subscribers and public safety personnel that an emergency has occurred at a specific location. Additionally implementations herein may provide real-time information that can utilized by on-site personnel and responding public safety personnel to mitigate the emergency.

Description of Related Information

The 1999 Columbine mass tragedy provoked serious rethinking of the model that law enforcement used to respond to that incident in particular, and, more generally, to shooting rampages involving "active shooters". Between 1965 and 1999, law enforcement developed and refined a tactical philosophy that stressed prompt containment by patrol officers and activation of specialists—SWAT teams and hostage negotiators—to handle such incidents. Within that framework, patrol officers, the first wave of response, usually arrived on scene in minutes, but lacked the equipment, teamwork and training in advanced tactics to act swiftly and effectively in high-risk incidents. Hence, their immediate focus was scene containment. Conversely, though they had the equipment, teamwork and advanced training to handle such incidents, specialized units often took up to an hour or more to respond and deploy at incident scenes. This state of affairs created a major gap in the law enforcement response to what are now called "active shooter incidents"; that gap, both cognitive and tactical, was a factor in the delay in entering and clearing a recent high school shooting incident quickly. It has led to the development and adoption of "active shooter" protocols throughout U.S. law enforcement.

While law enforcement has adapted quickly in the aftermath of Columbine and developed improved tactics to confront "active shooters" rapidly, school systems within the United States have been slower to adapt. Although protective infrastructure (e.g., fire alarms, sprinklers, CCTV, communication nets, evacuation maps) is standard in many schools to deal with common emergencies, such as fire or hazardous materials that usually require evacuation, shooting threats—particularly in suburban communities—have been largely ignored until Newtown, Connecticut. Interestingly, during the past 25 years, there hasn't been a death attributed to school fires in the United States (excluding dormitory fires). However, more than 200 persons—many of them children and teens—have been killed in "active shooter" incidents over the same period. It is a national tragedy that mass shootings pose the greatest threat to American school children today.

Indoor-gunshot detection technology—integrated into a comprehensive school-police-fire-medical response system—increases significantly the likelihood that active shooter threats will be identified quickly and that alerts will be triggered automatically (school personnel may be unable to send 911 or internal alerts because they are fully engaged in protective actions or themselves under attack). Further, as an integral component of such a system, the technology would promptly notify public safety responders about the nature and location of the incident. It would also make internal notifications to ensure that protective measures are taken throughout the school.

OVERVIEW

Systems and methods are disclosed involving combinations of integrated software and hardware components, designed to notify subscribers that an emergency/event such as gunfire has been detected at a particular location or within a defined area. Implementations include deployment of sensors, within a school for example, such that student-occupied interior rooms and external areas are covered by individual sensors which can detect gunfire.

Subscriber's to the present emergency notification system can be alerted using, but not limited to mobile cellular devices and computer networks.

Once activated by an event, implementations herein may provide site-based subscribers and public safety subscribers with information that can be utilized to potentially mitigate the emergency.

BRIEF DESCRIPTION OF THE DRAWINGS

The accompanying drawings, which constitute a part of this specification, illustrate various implementations and aspects of the innovations herein and, together with the description, help illustrate the principles of the present inventions. In the drawings.

DETAILED DESCRIPTION OF ILLUSTRATIVE IMPLEMENTATIONS

The present innovations relate generally to emergency notification systems and more specifically to a system and method for notifying site-based subscribers and public safety personnel that an emergency has occurred at a specific location. Additionally innovations herein provides information that can utilized by on-site personnel and responding public safety personnel to mitigate the emergency. The following description is presented to enable one having ordinary skill in the art to make and use the embodiment and is provided in the context of a patent application. The generic principles and features described herein will be apparent to those skilled in the art. Thus, the present embodiment is not intended to be limited to the embodiments shown, but is to be accorded the widest scope consistent with the principles and features described herein.

Figure 1:
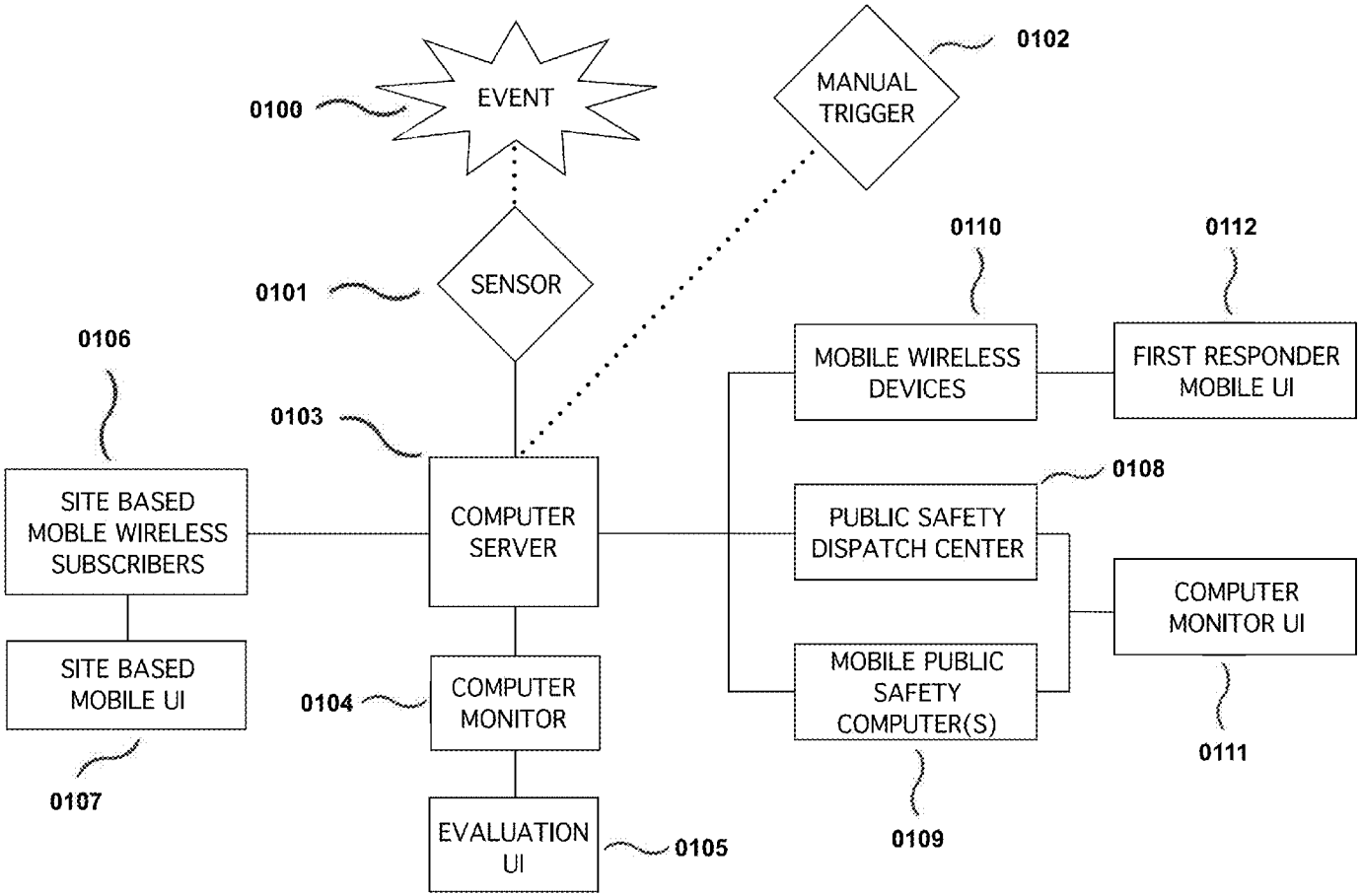
FIG. 1 is a block diagram showing illustrative components and features associated with the detection of gunfire, consistent with aspects related to the innovations herein.

FIG. 1 is a block diagram showing illustrative components and features associated with the detection of an event identified by predetermined system parameters 0100. In some implementations, a potential threat event (assailant brandishing a weapon) may additionally be identified via a manually triggered alert 0105, which may also be processed in association with the innovations herein. Event detections processed herein that may initiate innovative automated processes and enable user-initiated processes include, but are not limited to gunfire, simulated gunfire, explosions, the presence of detected chemical, biological or radiological elements, and any sounds and/or activity that can be detected, measured, and/or evaluated by either human interpretations or automated computer-driven processes.

When implementations herein receive input from a sensor 0101 that an event within the monitoring parameters of the invention has occurred 0100, or via a manually triggered alert 0102, a signal is transmitted to computer server 0103 for processing. Once received, the computer server will respond depending on a pre-configured response process which can include but is not limited to: (A) the alert and incident data is transmitted to a computer monitor 0104 where the data is evaluated by a human evaluator 0105. Based upon the interpretation of the incident data by the human evaluator, which includes a decision to classify the incident in a pre-determined category that will result in the transmission of the alert and incident data to site-based (location where the incident has been detected) mobile/wireless subscribers 0106 (received and viewed on a mobile device UI 0107) and additional alert subscribers such as, but not limited to pubic safety dispatch center personnel 0108, mobile public safety computers 0109, and public safety mobile/wireless devices 0110. Subscribers, who are not site-based, are able to receive alerts and incident data via a computer monitor user interface 0111 or a mobile device user interface 0112, or:

(B) The computer server 0103 will immediately transmit an alert to site-based subscribers 0106, and additional alert subscribers such as, but not limited to public safety dispatch center personnel 0108, mobile public safety computers 0109, and public safety mobile/wireless devices 0110 without being evaluated and classified by human monitors 0105.

Figure 2:
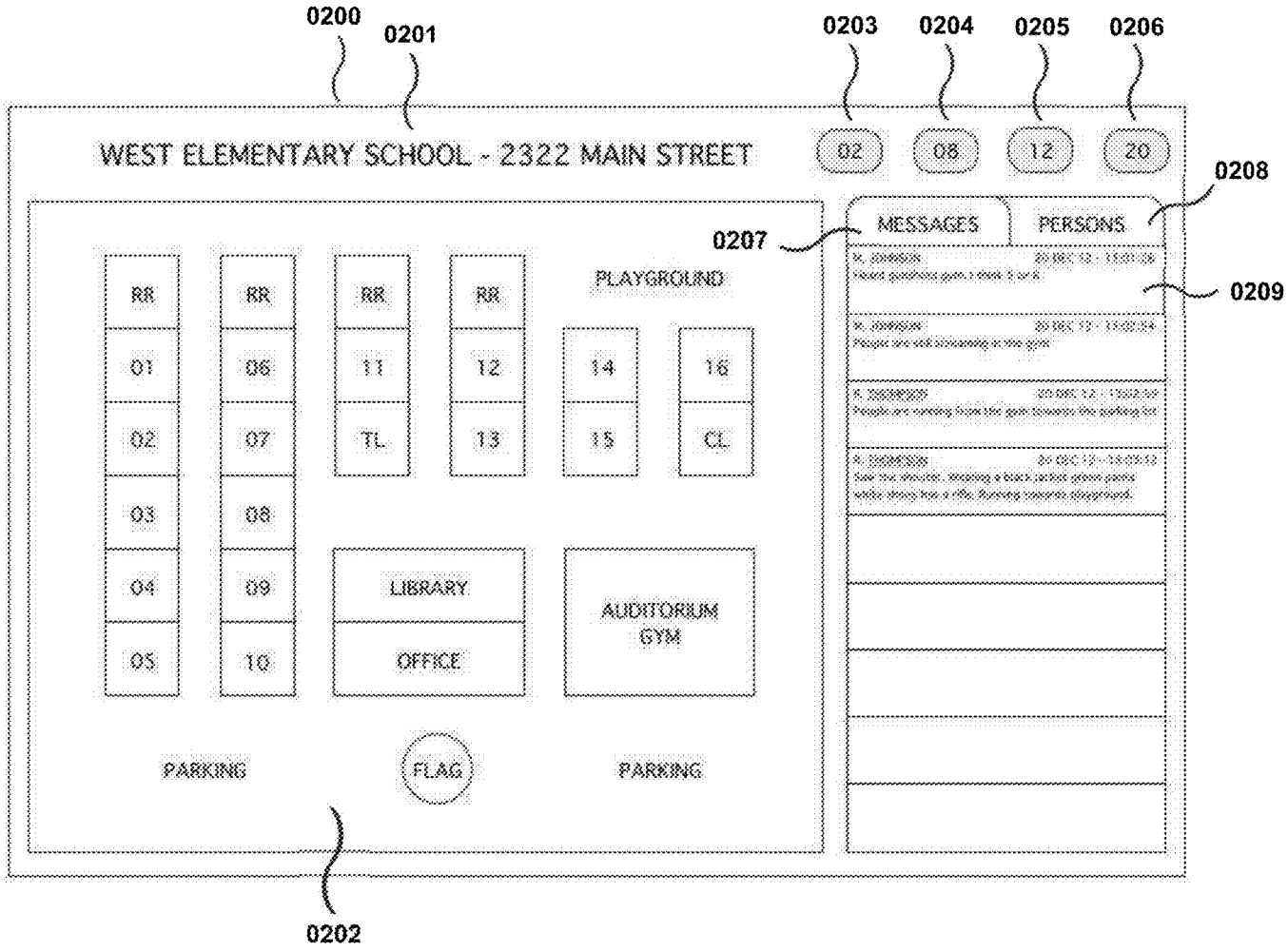
FIG. 2 is an illustration showing components of an illustrative graphical user interface, consistent with aspects related to the innovations herein.

FIG. 2 is an illustration of an exemplary graphical user interface 0200 (herein referred to as "public safety UI") utilized by, but not limited to public safety dispatch center personnel 0108, mobile public safety personnel using mobile computers 0109, and public safety personnel using mobile/wireless devices 0110 (shown in FIG. 01). The graphical user interface may include but is not limited to the following elements: a description of the location where the incident has been detected 0201, a map depicting the location 0202, status indicators that display status (multiple categories) of site-based subscribers 0203-0206, the ability to view sent and incoming electronic messages 0207, 0208, and the ability to view information related to site-based subscribers 0208. Gunshot locations detected by the sensors in the student occupied areas, including indoor and outdoor spaces, are provided for display on such user interfaces.

Figure 3:
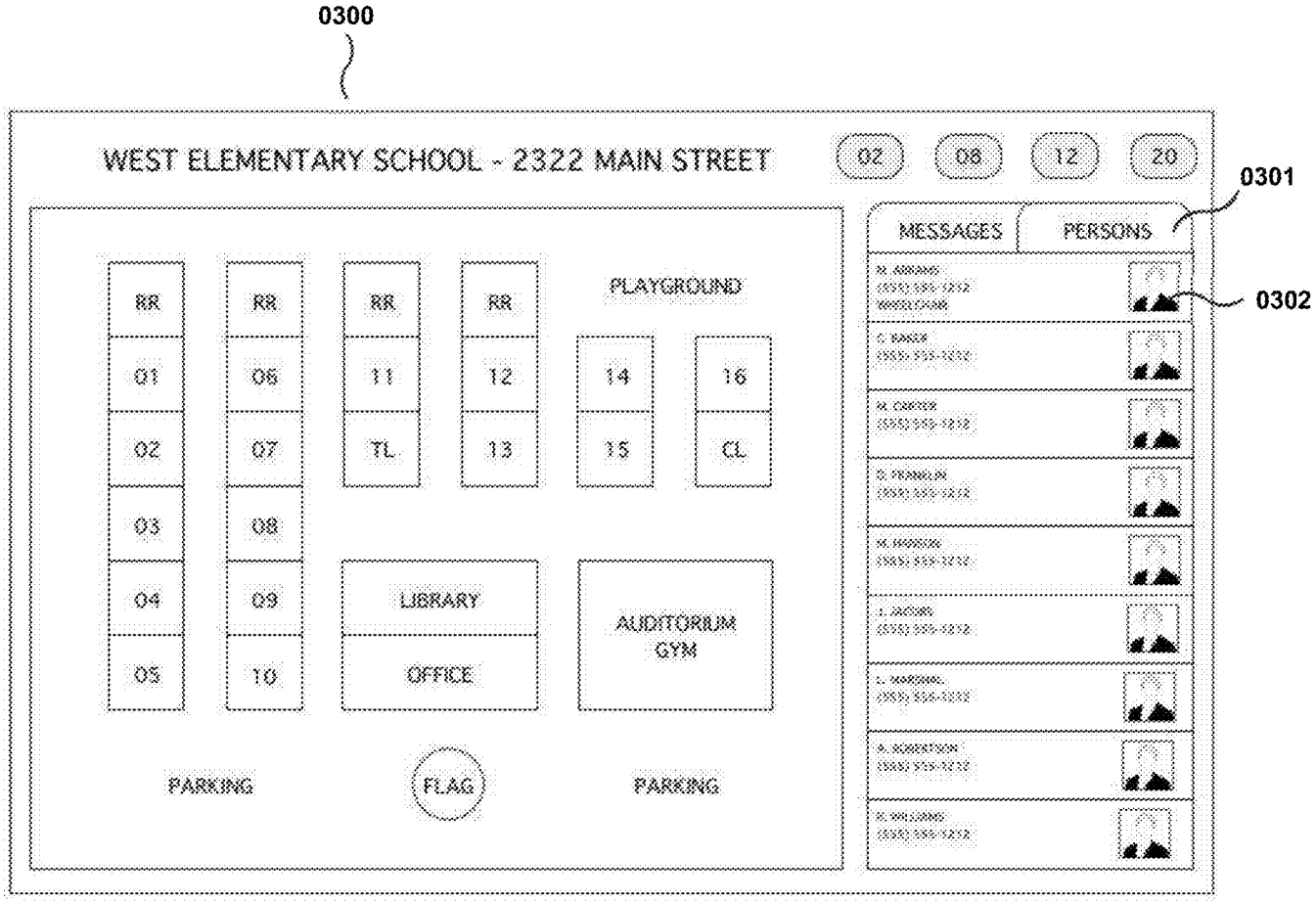
FIG. 3 is an illustration further showing components of an illustrative graphical user interface, consistent with aspects related to the innovations herein.

FIG. 3 is an additional illustration of the public safety UI 0300, showing additional functionality used to view information related to site-based subscribers 0301, 0302.

Figure 4:
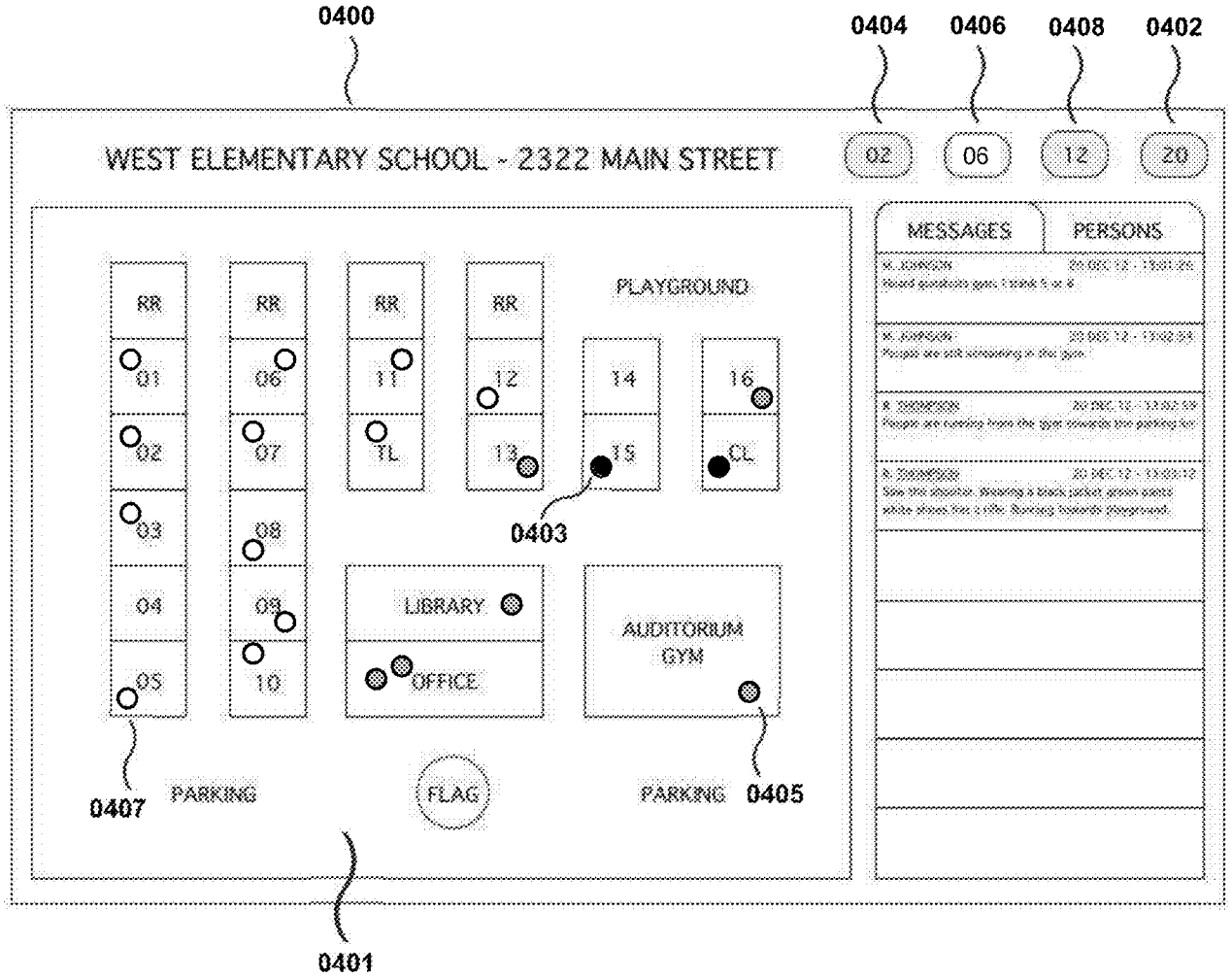
FIG. 4 is an illustration showing an illustrative graphical user interface displaying the location and status of persons monitored via present implementations, consistent with aspects related to the innovations herein.

FIG. 4 is an illustration showing an exemplary public safety UI 0400 displaying the location and status of site-based subscribers. In the example illustrated, a total of twenty (20) site-based subscribers (represented by circle icons) are graphically represented on the map element 0401 of the user interface. The total number of site-based subscribers detected within the geographic parameters of the area covered herein may be represented by an icon on the public safety UI 0402.

The presence of subscribers within the coverage area can be detected and mapped using, but not limited to the following technology platforms: global positioning systems (GPS), Wi-Fl triangulation, radio frequency identification (RFID) systems, as well as any technology developed in the future capable of tracking the location of persons in both indoor and outdoor environments.

FIG. 4 also illustrates the status of site-based subscribers during an incident. The relative status of individual subscribers can be represented visually using a variety of geometric shapes, colors, and behaviors such as, but not limited to flashing, pulsation, and other types of movement-based visual representations. As an example, in this illustration a solid black circle 0403 represents persons who have reported that persons in proximity to their location have been injured. An icon 0404 represents the total number of subscribers who are in proximity to injured persons. A circle with a grey interior 0405 represents subscribers who have failed to respond to a prompt asking for them to classify their status during the emergency. An icon 0406 represents the total number of subscribers who have failed to respond to this status request prompt. A circle with a white interior 0407 represents subscribers who have responded to a prompt asking them to classify their status during the emergency. An icon 0408 represents the total number of subscribers who have responded to this status request prompt.

Figure 5:
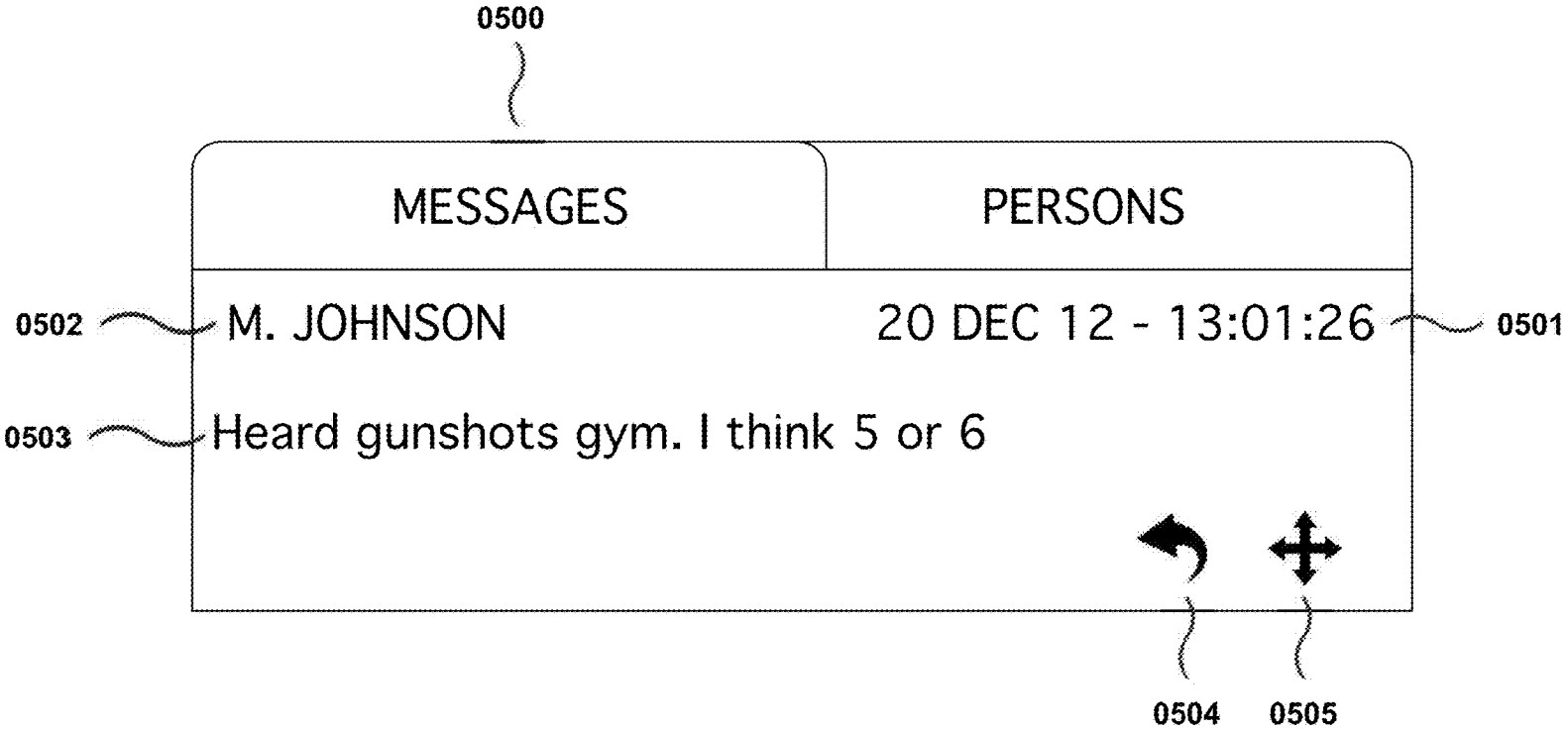
FIG. 5 is an illustration showing exemplary functionality of an illustrative tab component comprising an element of a graphical user interface, consistent with aspects related to the innovations herein.

FIG. 5 is an illustration showing the functionality of the messages tab 0500 located on the public safety UI (FIG. 02, 0207). Messages viewed using the messages tab display information to include, but not limited to the following: date and time the message was sent or received 0501, the username or identifying name of the sender 0502, message content 0503, an icon 0504, enabling the user to reply to the message from the public safety UI, and an icon 0505, enabling the user of the public safety UI to re-send the message to all subscribers.

Figure 6:
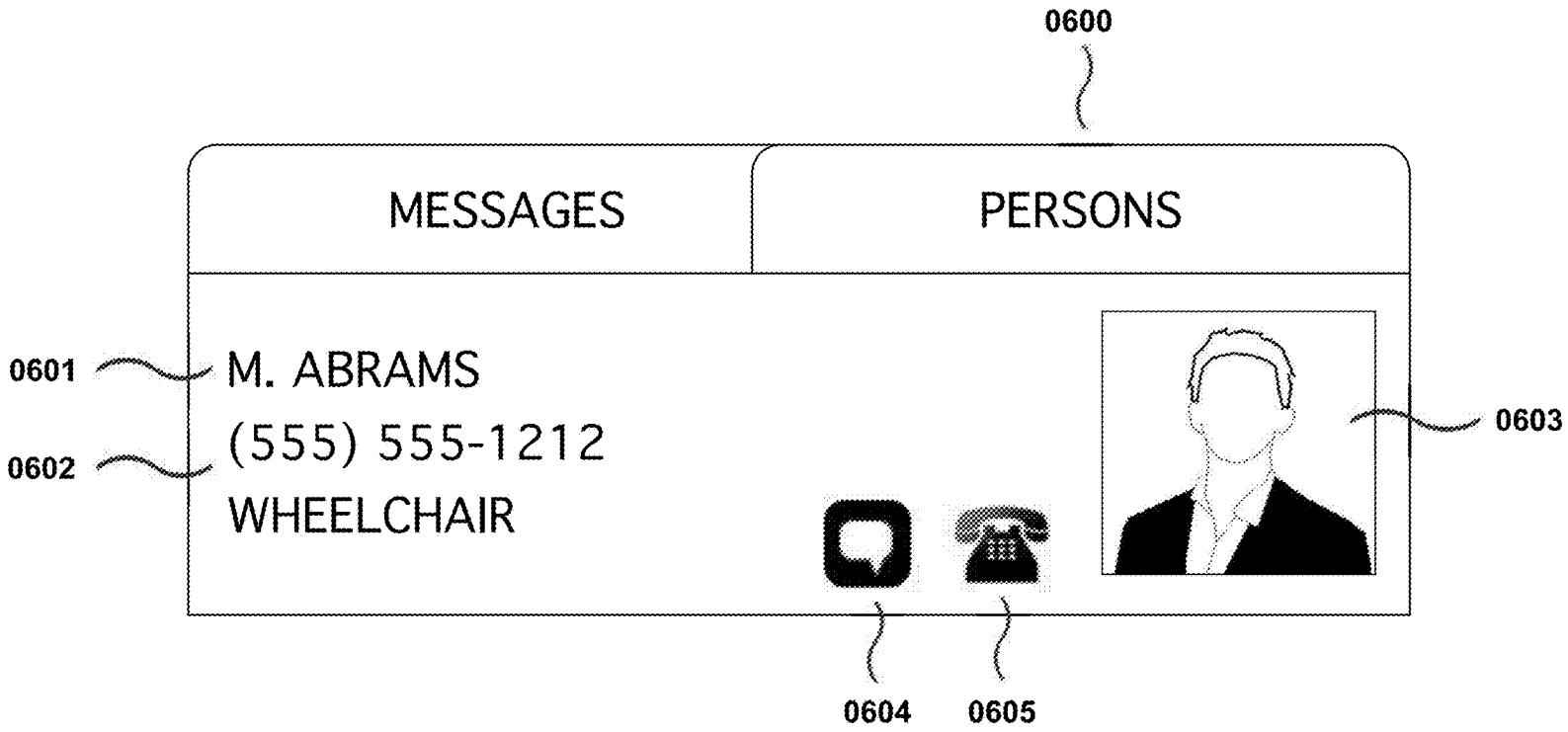
FIG. 6 is an illustration showing additional functionality of a tab component comprising an element of a graphical user interface, consistent with aspects related to the innovations herein.

FIG. 6 is an illustration showing the functionality of the persons tab located on the public safety UI (FIG. 02, 0208). The computer server (FIG. 01, 103) is able to store and display information relevant to location-based subscribers such as, but not limited to: the username or identifying name of the subscriber 0601, information such as the subscriber's telephone number and medical conditions 0602, and a photograph of the subscriber 0603. Additional icons with functionality such as, but not limited to the ability to directly message the subscriber 0604, and the ability to directly call the subscriber's mobile telephone or other phones 0605 are also displayed.

Figure 7:
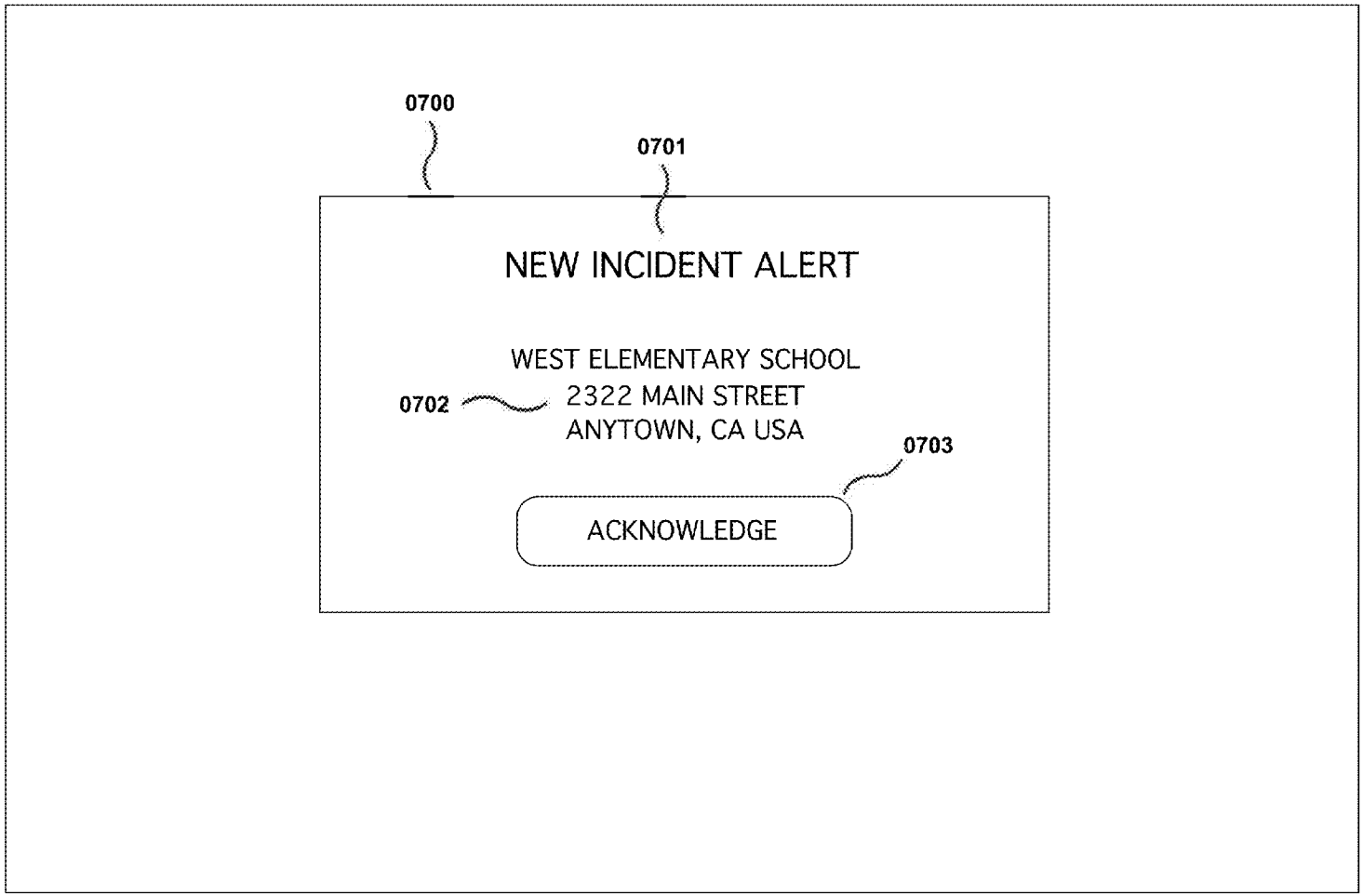
FIG. 7 is an illustration of an exemplary alert prompt that may appear on a mobile device to notify the user of an emergency, consistent with aspects related to the innovations herein.

FIG. 7 is an illustration of an alert prompt 0700 transmitted by the computer server (FIG. 01, 103) and displayed on a computer monitor integrated with systems and methods herein and configured to receive such alerts. These alerts may be issued in connection with a server that is configured to monitor a plurality of sites. Here, for example, the alert prompt may contain, though is not limited to the following information/functions: type of alert 0701, name of the facility and physical address where the event has been detected 0702, and a button 0703 which enables the user to acknowledge receipt of the alert.

Figure 8:
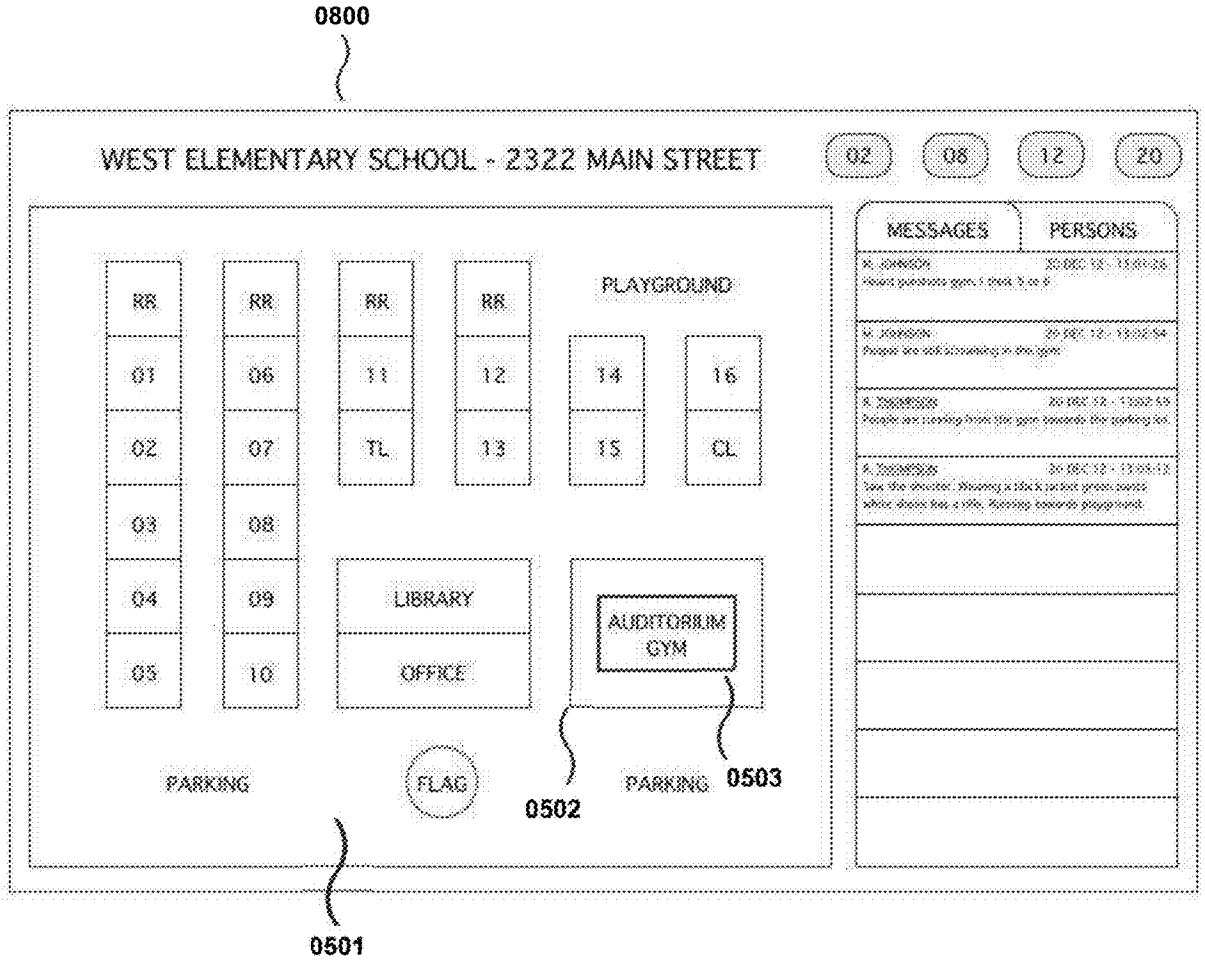
FIG. 8 is an illustration of an exemplary graphical user interface showing the location of detected gunfire, consistent with aspects related to the innovations herein.

FIG. 8 is an illustration showing how the public safety UI 0800 displays the location of a detected event to include but not limited to incidents of gunfire, simulated gunfire, explosions, the presence of detected chemical, biological or radiological elements, and any sounds and/or activity that can be detected, measured, and/or evaluated by either human interpretations or automated computer-driven processes. The location of the detected event is displayed on the public safety UI map 0501 at the location using a visual identifier such as, but not limited to combinations of geometric shapes and colors. In the example shown in FIG. 08, an incident of gunfire is visually represented within the auditorium/gym building 0502 by a square 0503 surrounding the name of the building. The visual representation of the gunfire incident may be augmented by various visual indicia, such as square 0503 being displayed as a blinking box.

Figure 9:
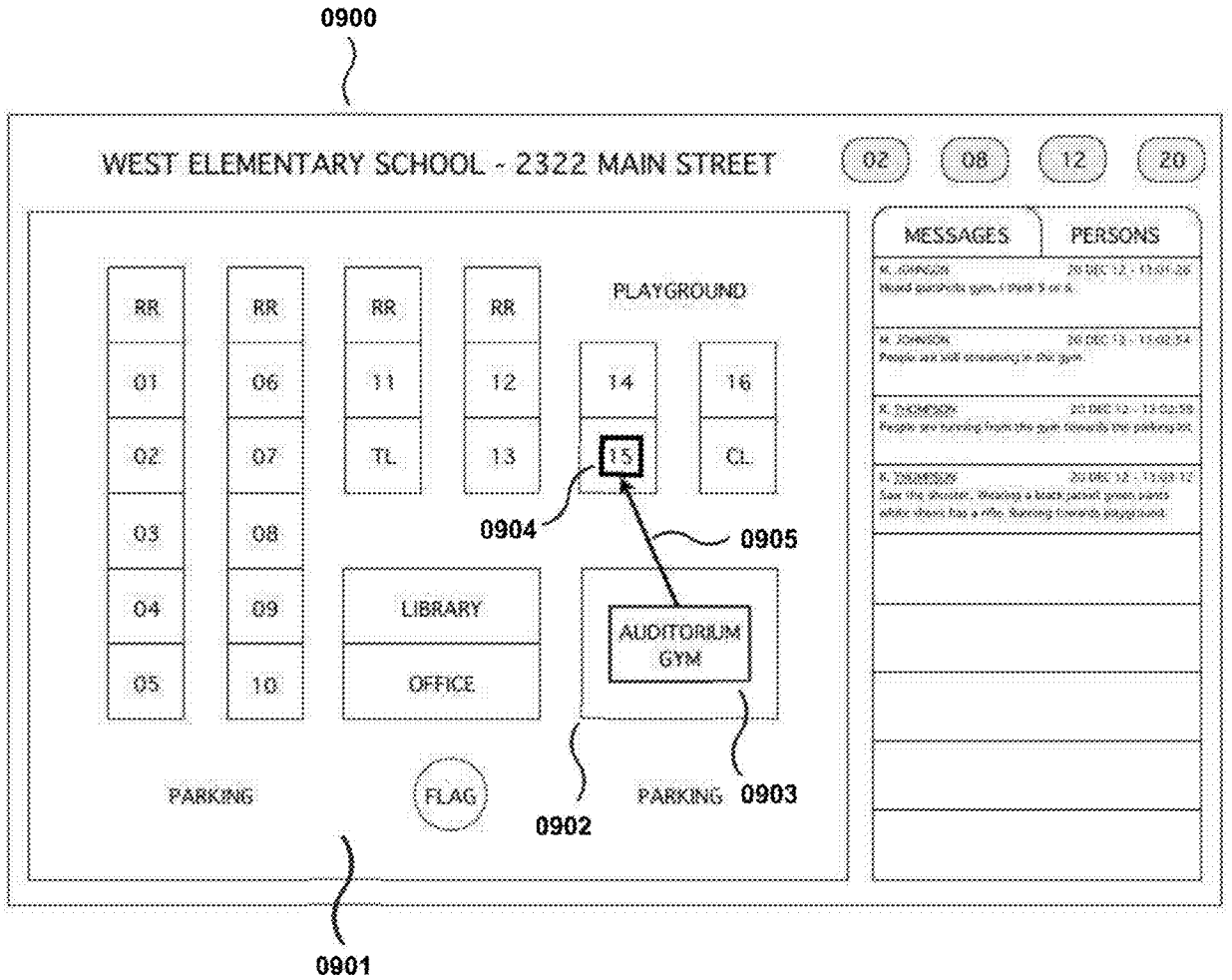
FIG. 9 is an illustration of an exemplary graphical user interface showing two different incidents of detected gunfire, consistent with aspects related to the innovations herein.

FIG. 9 is an illustration showing how the public safety UI displays the location of multiple detected events. In the example shown, two incidents of gunfire are displayed on the public safety UI map 0901. The first detected incident of gunfire is visually represented within the auditorium/gym building 0902 by a square 0903 surrounding the name of the building. A second incident of detected gunfire is visually represented within "room 15" by a square 0904 surrounding the room number. The chronological order in which the events were detected is visually represented by an arrow 0905 connecting the two incidents with the head of the arrow pointing towards the more recent of the two events. Additionally, the chronological order is also represented by the visible "thickness" of the squares representing an incident of gunfire. The relative "thickness" of the squares becomes progressively thicker as each new incident is detected and represented on the map.

Figure 10:
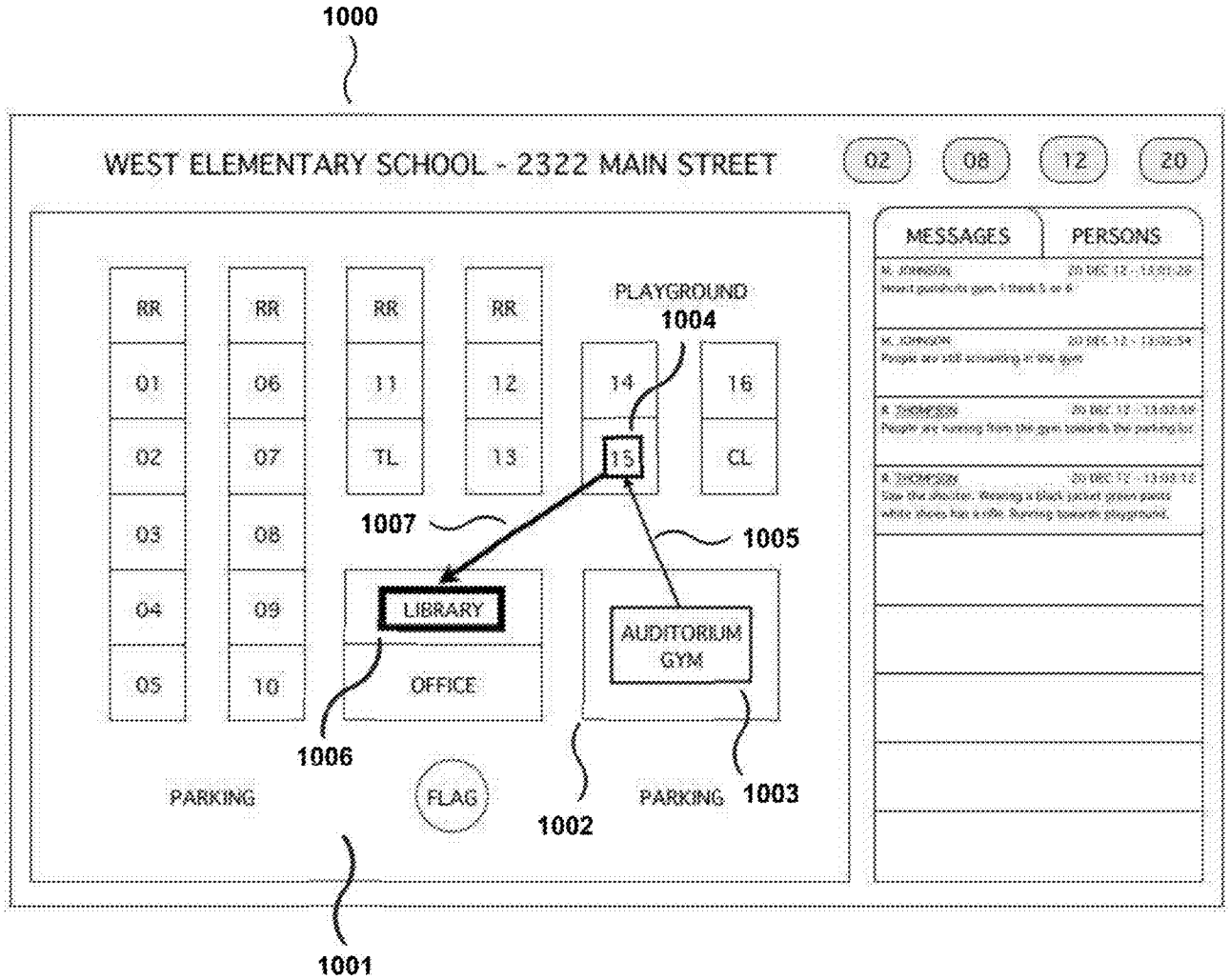
FIG. 10 is an illustration of an exemplary graphical user interface showing three different incidents of detected gunfire, consistent with aspects related to the innovations herein.

FIG. 10 is an additional illustration showing how the public safety UI displays the location of multiple detected events. In the example shown, three incidents of gunfire are displayed on the public safety UI map 1001. The first detected incident of gunfire is visually represented within the auditorium/gym building 1002 by a square 1003 surrounding the name of the building. A second incident of detected gunfire is visually represented within "room 15" by a square 1004 surrounding the room number. The chronological order in which the events were detected is visually represented by an arrow 1005 connecting the two incidents with the head of the arrow pointing towards the more recent of the two events. A third incident of detected gunfire visually represented within the "library" by a square 1006 surrounding the room name. The chronological order in which the events were detected is visually represented by an arrow 1007 connecting the second incident 1004 and the third incident 1006 with the head of the arrow pointing towards the more recent of the last two events. The relative "thickness" of the chronological arrows also becomes progressively thicker as each new incident is detected and represented on the map.

Figure 11:
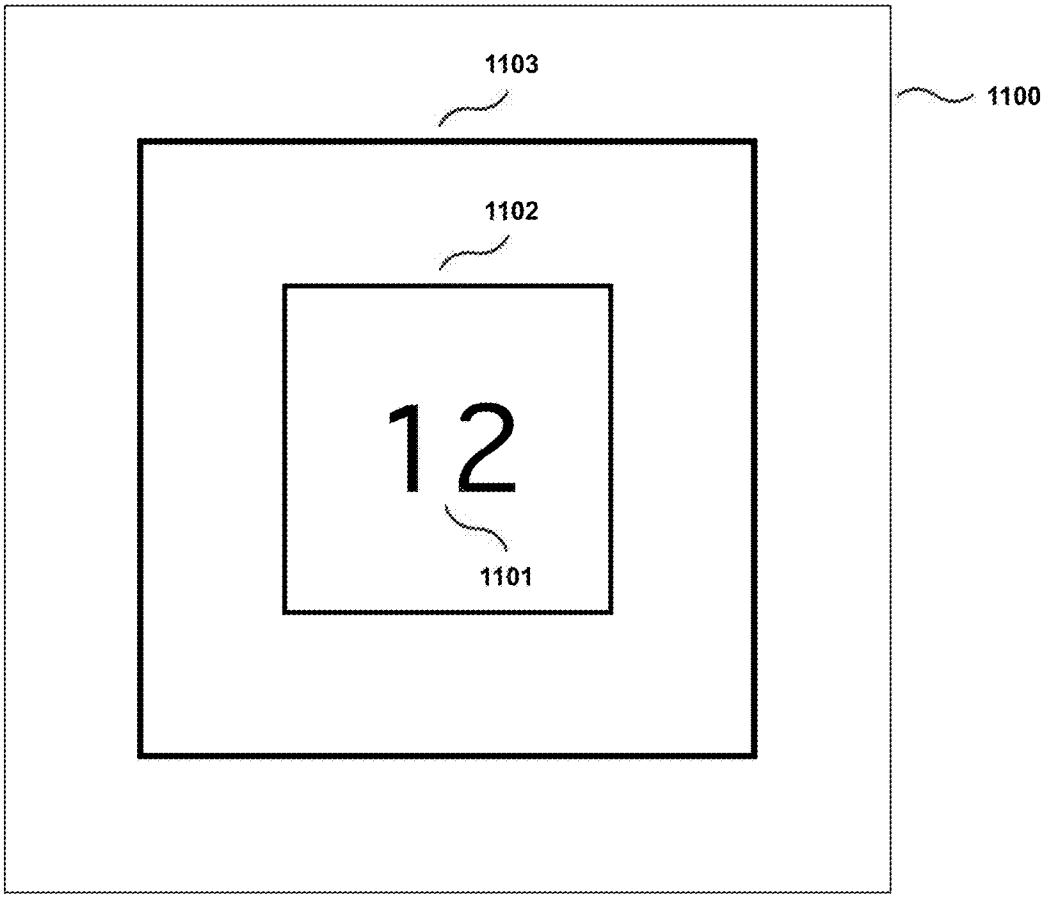
FIG. 11 is an illustration showing how an exemplary graphical user interface displays multiple incidents of detected gunfire within a defined area such as a room, indoor space, or hallway, consistent with aspects related to the innovations herein.

FIG. 11 is an illustration showing how the public safety UI displays the location of multiple detected events within an identified room or area with identified boundaries. In the example shown, two incidents of gunfire have occurred within the boundaries 1100 of room "12" (labeled on the map with the number 12, 1101). The first incident of gunfire is represented by the innermost square 1102 surrounding the room number. The second incident of gunfire is represented by a second square 1103 surrounding both the room number 1101 and square representing the first incident of detected gunfire 1102. The lines comprising the squares representing detected incidents of gunfire 1102, 1103 also become progressively thicker to represent the chronological order of the detected incidents.

Figure 12:
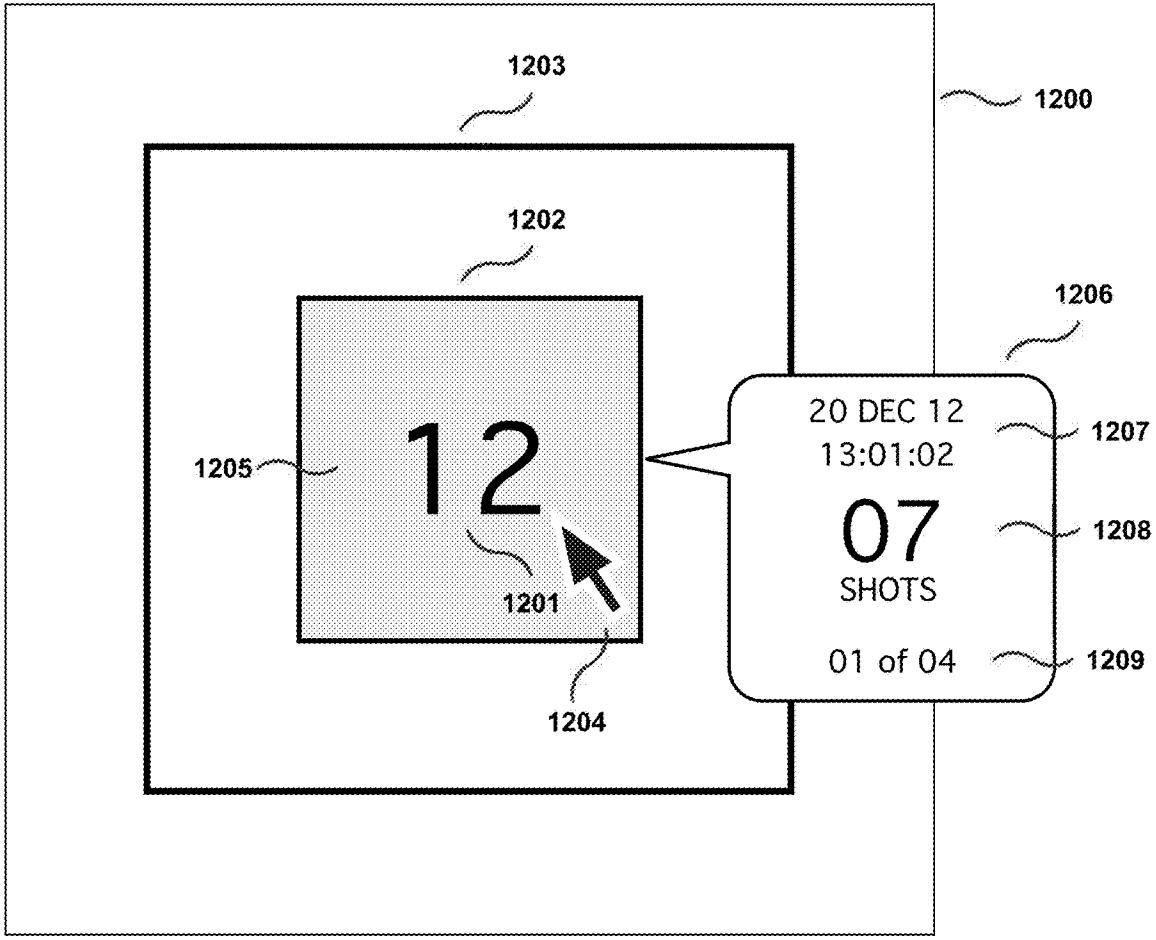
FIG. 12 is an illustration showing the functionality of an exemplary graphical user interface when a computer cursor is placed over a displayed incident of detected gunfire, consistent with aspects related to the innovations herein.

FIG. 12 is an illustration showing the functionality and ability to display information concerning incidents of detected gunfire incidents. In the example shown, two incidents of gunfire have occurred within the boundaries 1200 of room "12" (labeled on the map with the number 12, 1201). The first incident of gunfire is represented by the innermost square 1202 surrounding the room number. The second incident of gunfire is represented by a second square 1203 surrounding both the room number 1201 and square representing the first incident of detected gunfire 1202. When the public safety UI's cursor 1204 is placed within the boundaries of the square representing the first incident of detected gunfire 1205, the area changes color and a visual representation of the data associated with the first incident becomes visible 1206. The information displayed regarding the selected incident can include, but is not limited to: the date and time the incident was detected 1207, the number of events (i.e. gunshots) that occurred within the detected incident 1208, and the total number of incidents detected to include the chronological position of the incident being viewed 1209.

Figure 13:
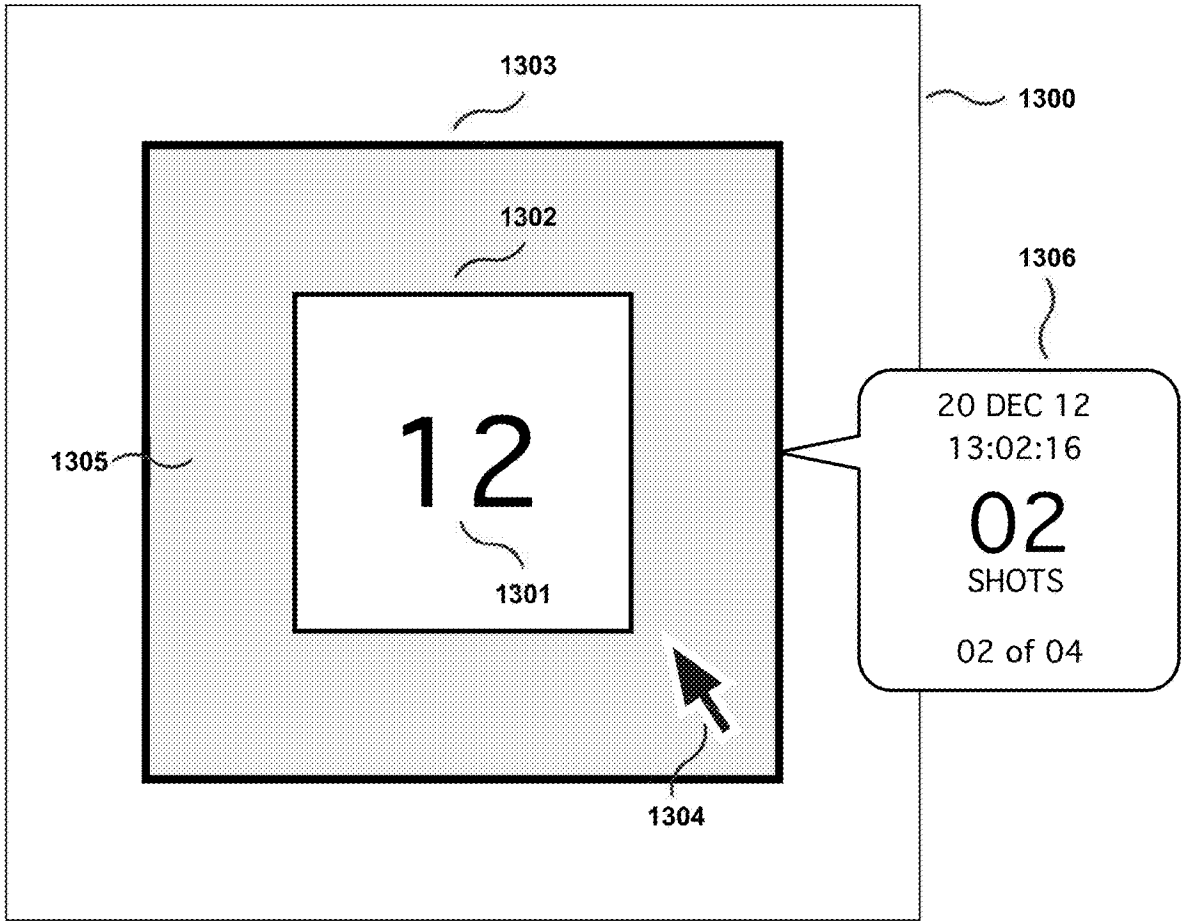
FIG. 13 is an illustration showing the functionality of an exemplary graphical user interface when a computer cursor is placed over an incident of detected gunfire in a defined area where multiple incidents of gunfire have been detected and are displayed, consistent with aspects related to the innovations herein.

FIG. 13 is a second illustration showing the functionality and ability to display information concerning multiple incidents of detected gunfire incidents within an identified room or area with identified boundaries. In the example shown, two incidents of gunfire have occurred within the boundaries 1300 of room "12" (labeled on the map with the number 12, 1301). The first incident of gunfire is represented by the innermost square 1302 surrounding the room number. The second incident of gunfire is represented by a second square 1303 surrounding both the room number 1301 and square representing the first incident of detected gunfire 1302. When the public safety UI's cursor 1304 is placed within the boundaries of the square representing the second incident of detected gunfire 1305 and outside the boundaries of the square representing the first incident of detected gunfire 1302, the area changes color and a visual representation of the data associated with the first incident becomes visible 1306.

Figure 14:
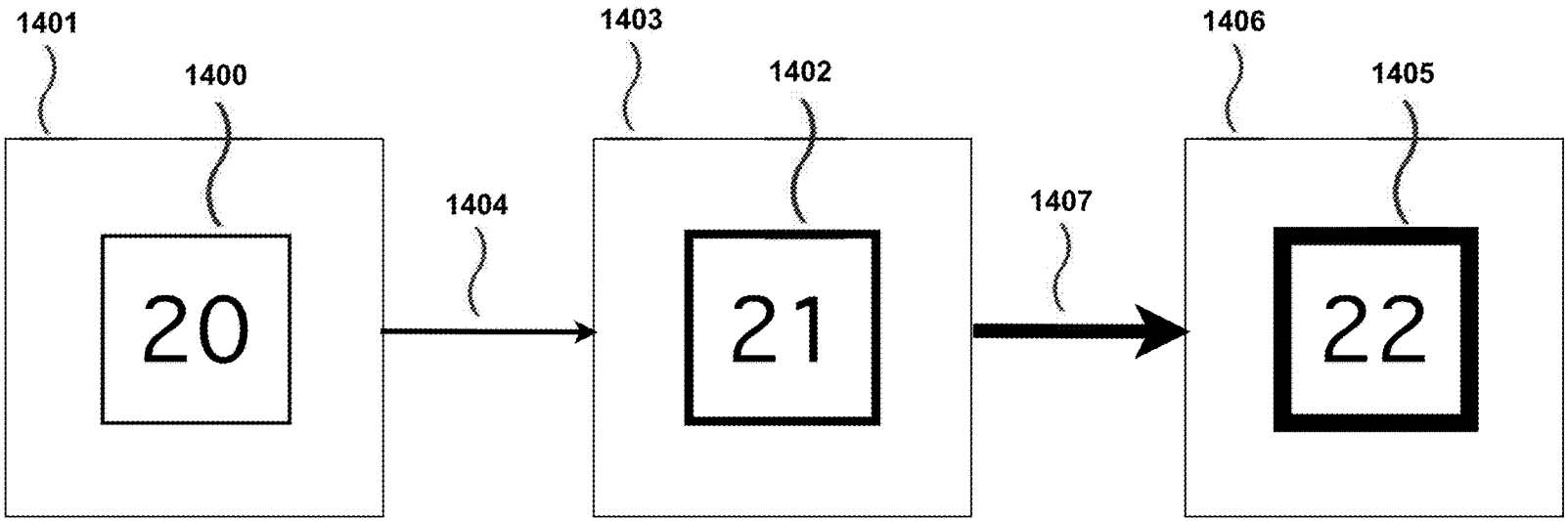
FIG. 14 is an illustration showing the functionality of an exemplary graphical user interface used to differentiate multiple incidents of detected gunfire during an incident in chronological order, consistent with aspects related to the innovations herein.

FIG. 14 is an illustration showing the visual representations used by the public safety UI to show the chronological order of detected events. In this example, an event 1400 has been detected within the boundaries 1401 of "room 20". A second event 1403 is detected within the boundaries 1404 of "21" causing an arrow 1404 to connect both detected incidents. The head of the arrow points towards the most recently detected event. The lines forming the square indicating the second event detection 1402 are displayed more thickly than the lines forming the square indicating the first event detection 1400 to represent the chronological order of detection. When a third event 1405 is detected within the boundaries 1406 of "room 21" an arrow 1407 is displayed to connect the second and third detected incidents. The head of the arrow points towards the most recently detected event. The lines forming the square indicating the third event detection 1405 are displayed more thickly than the lines forming the square indicating the second event detection 1402 to represent the chronological order of detection. Additionally the arrow 1407 representing the order between the second and third event is displayed more thickly than the arrow displayed between the first and second events.

Figure 15:
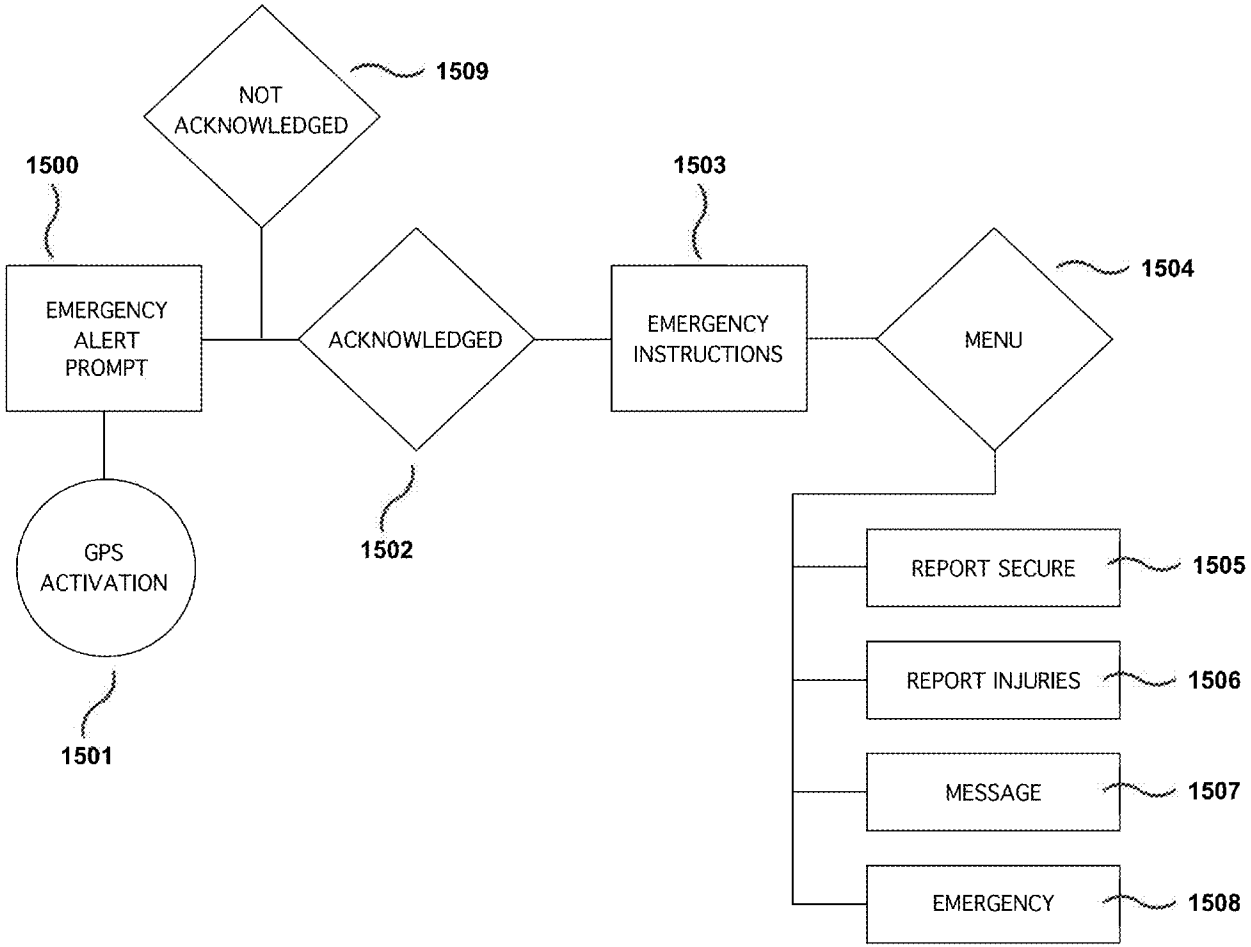
FIG. 15 is a flowchart illustration showing exemplary processes and functionality regarding the alerting of location-based mobile subscribers and the ability for subscribers to provide status updates, consistent with aspects related to the innovations herein.

FIG. 15 is a flowchart illustration showing the processes and functionality of innovations associated with alert prompts sent to site-based subscribers (Depicted in FIG. 01 106,107). Once an event has been detected and the configured parameters have been met to cause the transmission of an alert prompt 1500 to the mobile devices of site-based subscribers, software installed on the mobile devices of site-based subscribers will transmit the location of such devices in real-time to the computer server (FIG. 01, 103). The alert prompt will ask the site-based subscriber to acknowledge the alert prompt, which when acknowledged 1502 will cause the user's mobile device to display emergency instructions 1503 and a number of status reporting options 1504 such as, but not limited to the ability to report that the emergency instructions have been followed and the area in which the site-based subscriber is present is secure 1505, the ability to report injuries in proximity to the site-based subscriber 1506, the ability to send messages to the public safety UI 1507, and the ability to report a significant emergency in the proximity of the site-based subscriber 1508. If the site-based subscriber fails to acknowledge the alert prompt 1509, the computer server will classify the site-based subscriber's status as "not acknowledged".

When a site-based subscriber uses their site-based mobile subscriber UI to report a "secure" status 1505, the user's status and location is visually represented on the public safety UI (FIG. 04, 0407) and their status is counted in the appropriate icon representing the total number of site-based subscribers who have reported a "secure status" (FIG. 04, 408).

When a site-based subscriber uses their site-based mobile subscriber UI to report "injuries", the user's status and location is visually represented on the public safety UI (FIG. 04, 0403) and their status is counted in the appropriate icon representing the total number of site-based subscribers who have reported a injuries (FIG. 04, 404).

When a site-based subscriber fails to use their site-based mobile subscriber UI to acknowledge an alert prompt 1509, the user's status and location is visually represented on the public safety UI (FIG. 04, 0405) and their status is counted in the appropriate icon representing the total number of site-based subscribers who have failed to respond to the alert prompt acknowledgement request (FIG. 04, 406).

When a site-based subscriber uses their site-based mobile UI to acknowledge an "emergency" (i.e. the suspect is attempting to break down the locked door to their classroom) an emergency prompt is displayed on the public safety UI.

Figure 16:
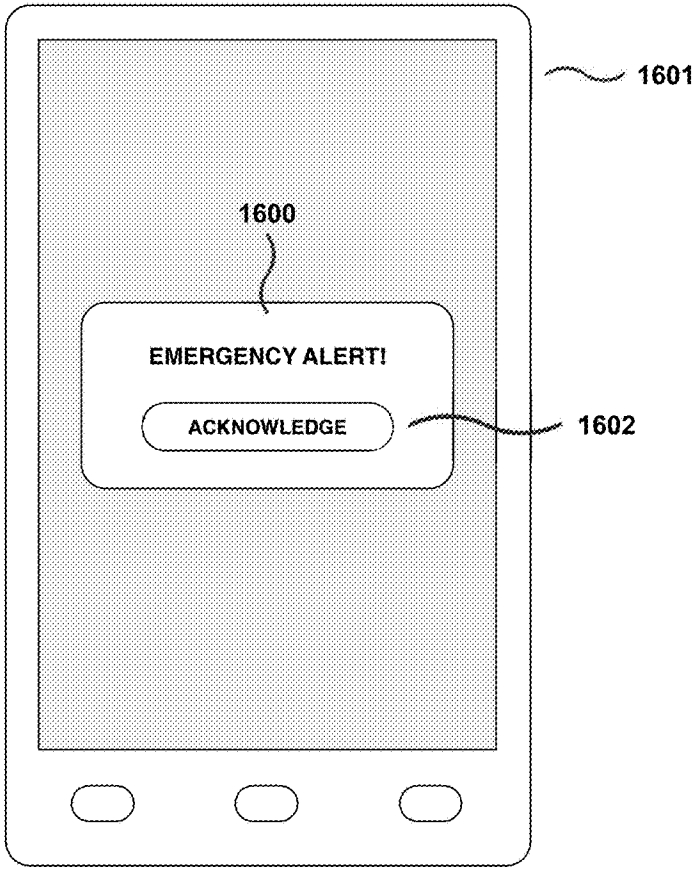
FIG. 16 is an illustration showing an example of the alert prompt received by location-based mobile subscribers to notify users that an emergency is in-progress and/or that gunfire has been detected, consistent with aspects related to the innovations herein.

FIG. 16 is an illustration showing an embodiment of an exemplary alert prompt 1600 that is transmitted by the computer server (FIG. 01, 0103) to site-based mobile subscribers on a mobile device 1601 to make notification of an emergency. The alert prompt also displays an acknowledgement button 1602 that allows users to notify the computer server that the alert prompt has been received.

Figure 17:
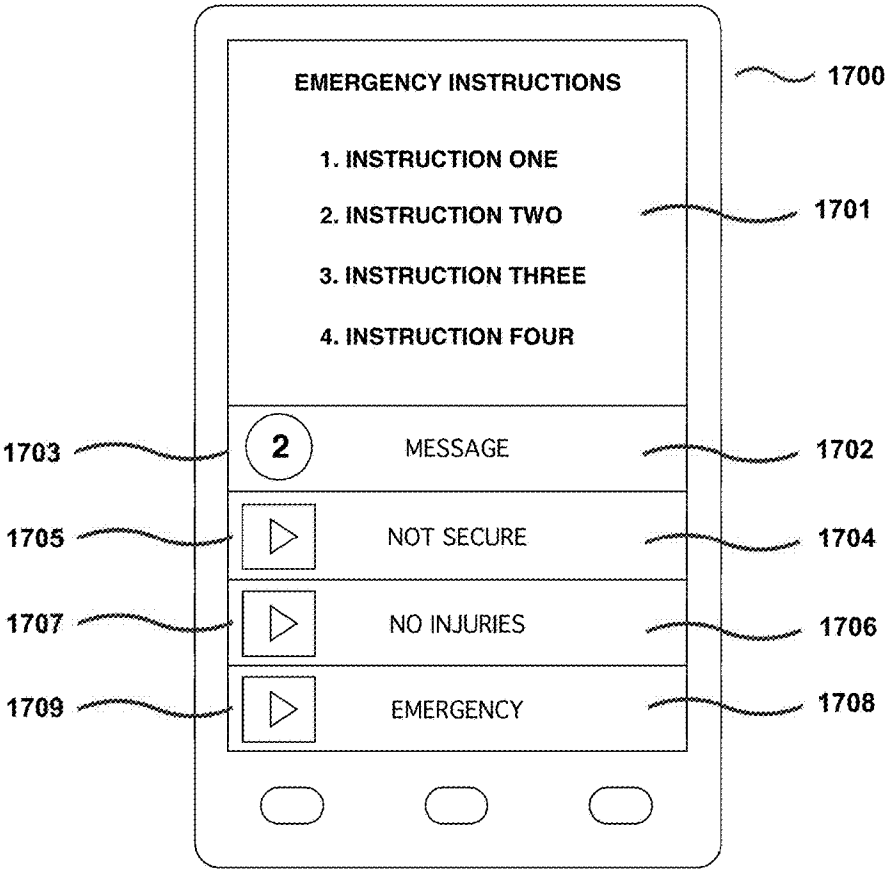
FIG. 17 is an illustration showing elements of an exemplary graphical user interface used by location-based mobile subscribers, consistent with aspects related to the innovations herein.

FIG. 17 is an illustration showing an embodiment of an exemplary site-based mobile subscriber user interface that is displayed on the user's mobile device 1700 once the user acknowledges a received alert prompt (FIG. 16, 1600). The interface is utilized by touch-screen gestures on any configured mobile device. The exemplary site-based mobile subscriber user interface contains, but is not limited to the following elements: emergency instructions 1701, a messaging function 1702 which includes a visual representation of received and unread messages 1703, the ability to report the user's status 1704 using a touch-screen "swiping" gesture 1705, the ability to report injuries 1706 using a touch-screen "swiping" gesture 1707, and the ability to report an emergency 1708 using a touch-screen "swiping" gesture 1709.

Figure 18:
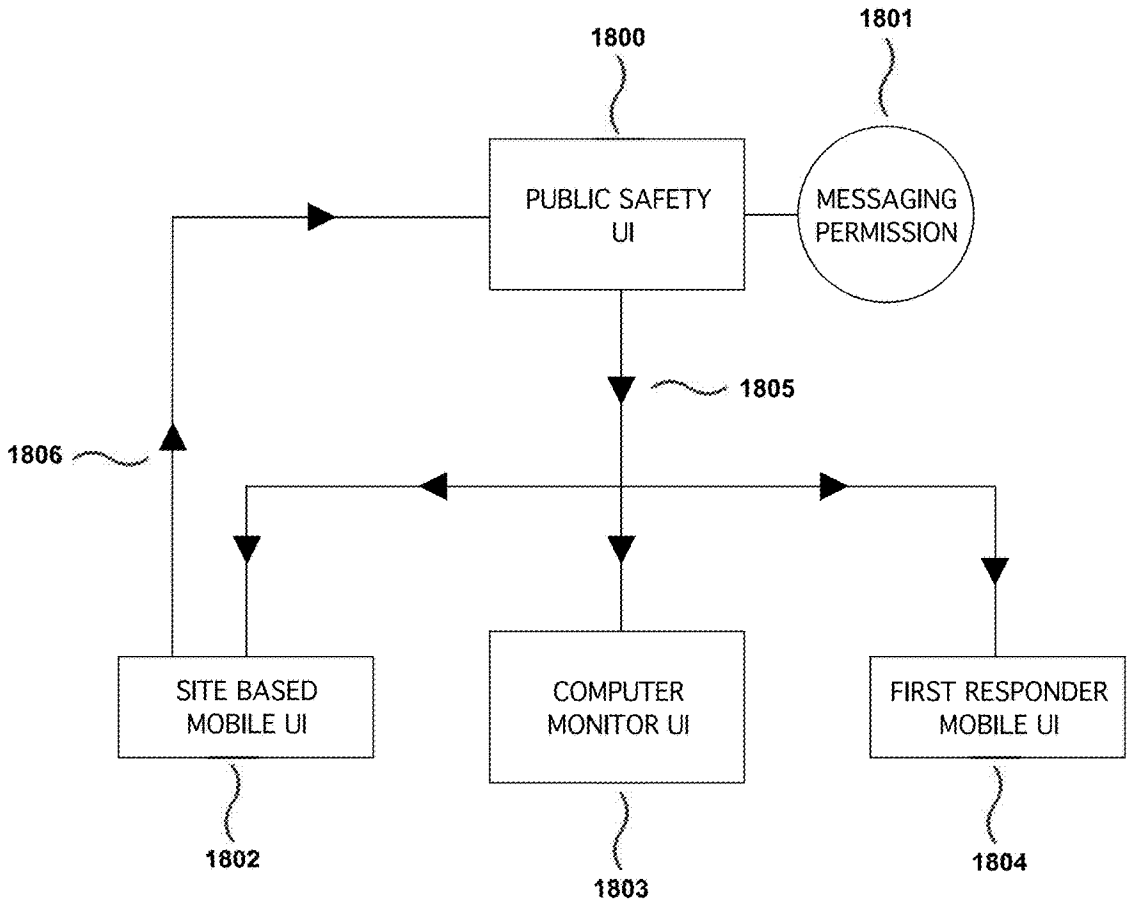
FIG. 18 is a flowchart illustration showing messaging functionality of an exemplary implementation, consistent with aspects related to the innovations herein.

FIG. 18 is a flowchart illustration showing exemplary messaging functionality between the public safety UI 1800 configured with messaging permission 1801, site-based mobile subscribers 1802, computer-based public safety subscribers 1803, and responders using the inventions public safety mobile user interface 1804. The public safety UI can be configured to send messages 1805 to individual users or to all subscribers linked to an event. Location-based mobile subscribers can send messages to the public safety UI 1806, but are prevented from messaging other site-based subscribers directly. The public safely UI 1800, can however, resend messages received from site- based mobile subscribers to all subscribers linked to an event 1802-1804.

Figure 19:
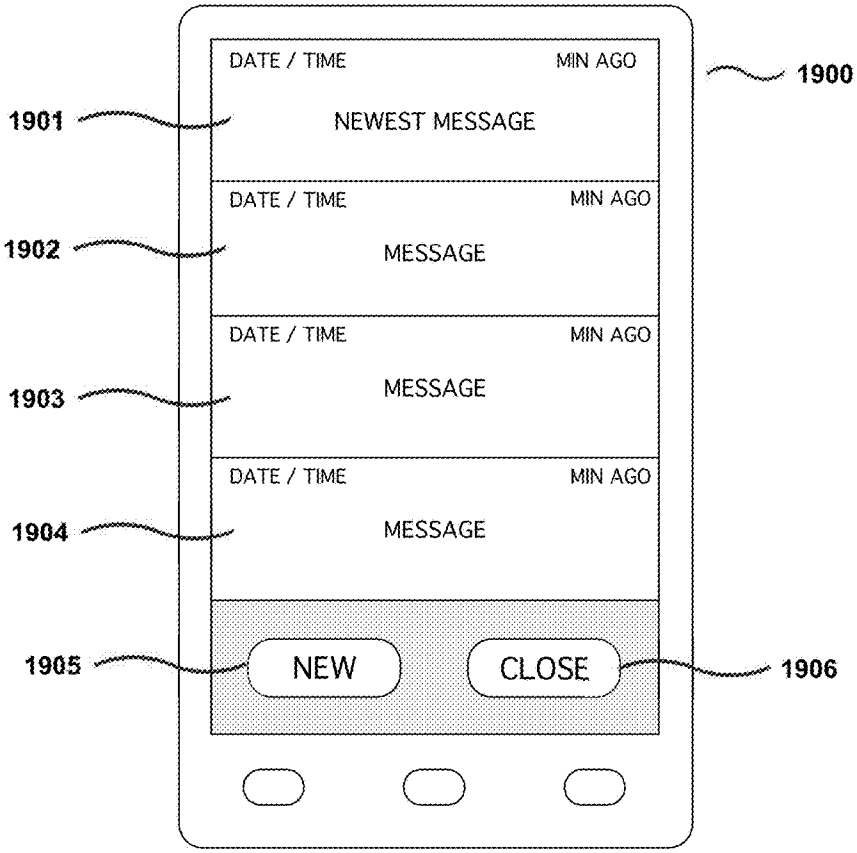
FIG. 19 is an illustration showing an exemplary graphical user interface used by location-based mobile subscribers to display messages, consistent with aspects related to the innovations herein.

FIG. 19 is an illustration showing the functionality of the messaging component of the site-based mobile subscriber user interface. The messaging interface is accessed by using the touch screen messaging function in the main menu (FIG. 17, 1702). An illustrative messaging interface on a site-based subscriber's mobile device 1900, may display, but is not limited to the following elements: sent and received messages in chronological order 1901-1904, a button to generate new messages 1905, and a "close" button 1906 that returns the user to the main menu (FIG. 17).

Figure 20:
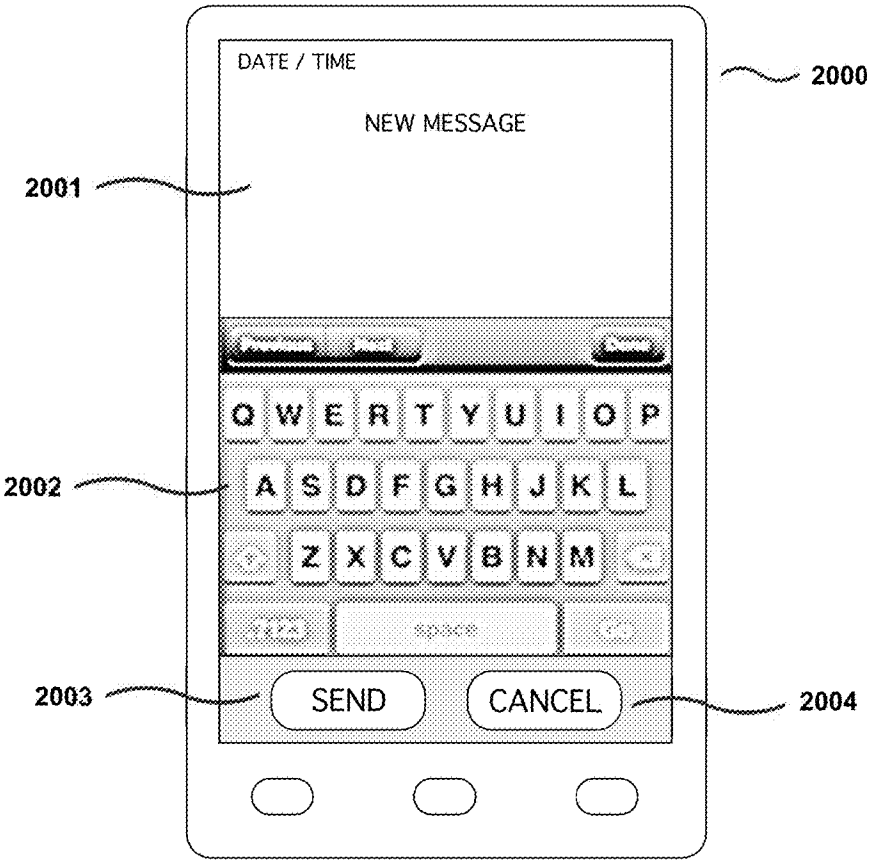
FIG. 20 is an illustration showing an exemplary graphical user interface used by location-based mobile subscribers to send messages, consistent with aspects related to the innovations herein.

FIG. 20 is an illustration showing the functionality of the messaging component of the site-based mobile subscriber user interface used to compose new messages on a mobile device 2000. An illustrative message composition interface may include, but is not limited to, the following elements: a visual display of the message being composed 2001, a touch-screen keyboard used to compose new messages 2002, a button used to transmit new messages 2003, and a button used to cancel the composition of a new message 2004.

Figure 21:
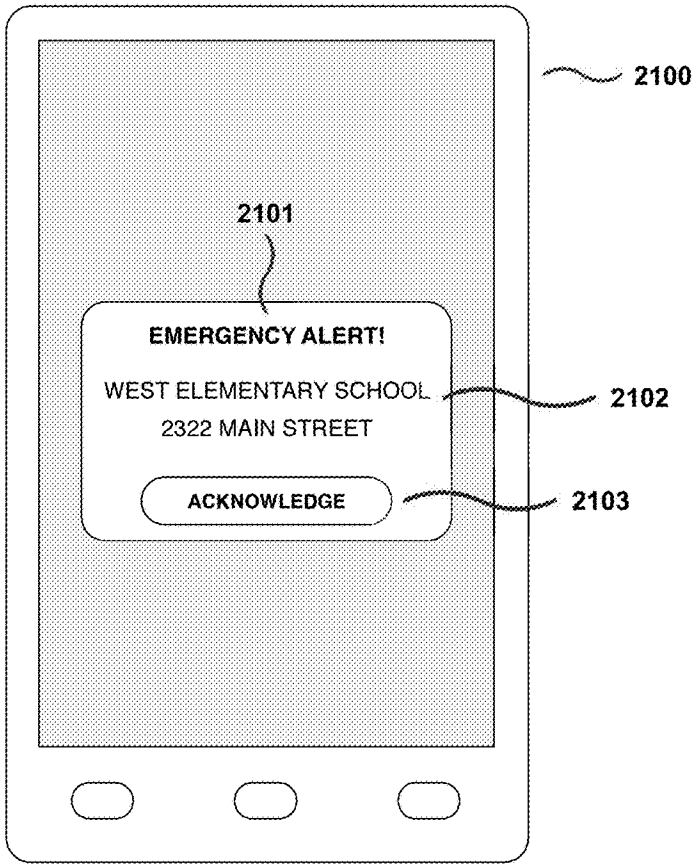
FIG. 21 is an illustration showing an exemplary alert prompt received by public safety personnel subscribers to notify users of an emergency and/or that gunfire has been detected, consistent with aspects related to the innovations herein.

FIG. 21 is an illustration showing an embodiment of the alert prompt transmitted to public safety mobile device subscribers to provide notification of an emergency. The alert prompt displayed on the mobile device 2100 of a public safety mobile subscriber are, but not limited to the following elements: type of alert 2101, description and physical address of the event location 2102, and a button 2103 to acknowledge receipt of the alert prompt.

Figure 22:
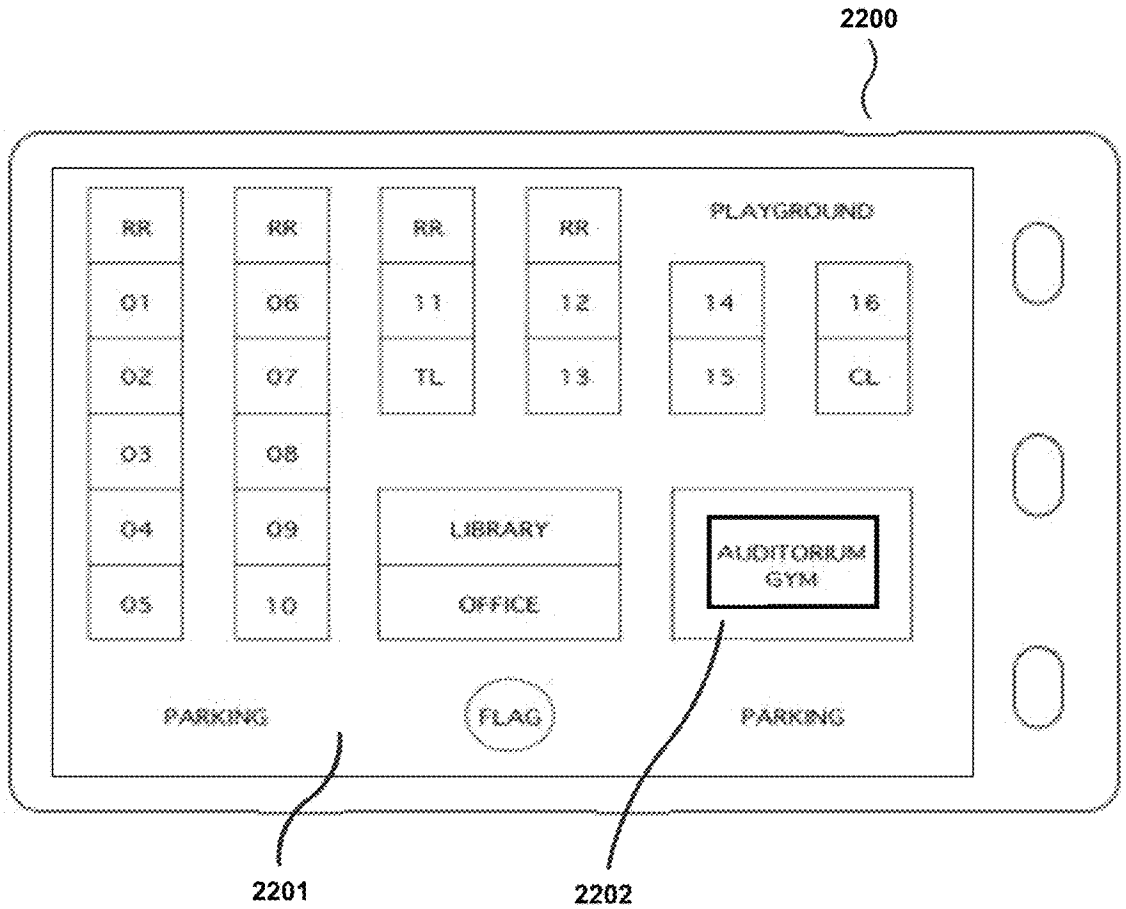
FIG. 22 is an illustration showing an exemplary graphical user interface for mobile devices used by public safety personnel to view the location of detected gunfire incidents, consistent with aspects related to the innovations herein.

FIG. 22 is an illustration showing an embodiment of the public safety mobile device subscribers user interface used to display detected events. The user interface consists of, but is not limited to the following elements that are capable of being displayed on a mobile device 2200: a map depicting the location of the event 2201 and the specific location of detected events 2202.

The public safety mobile device user interface can utilize the same graphical interface elements to depict incident data as the public safety UI (FIG. 02, 200) and can be configured to display the elements depicted in FIGS. 02, 03, 04, 05, 06, 08, 09, 10, and 11-14 and described herein.

Figure 23:
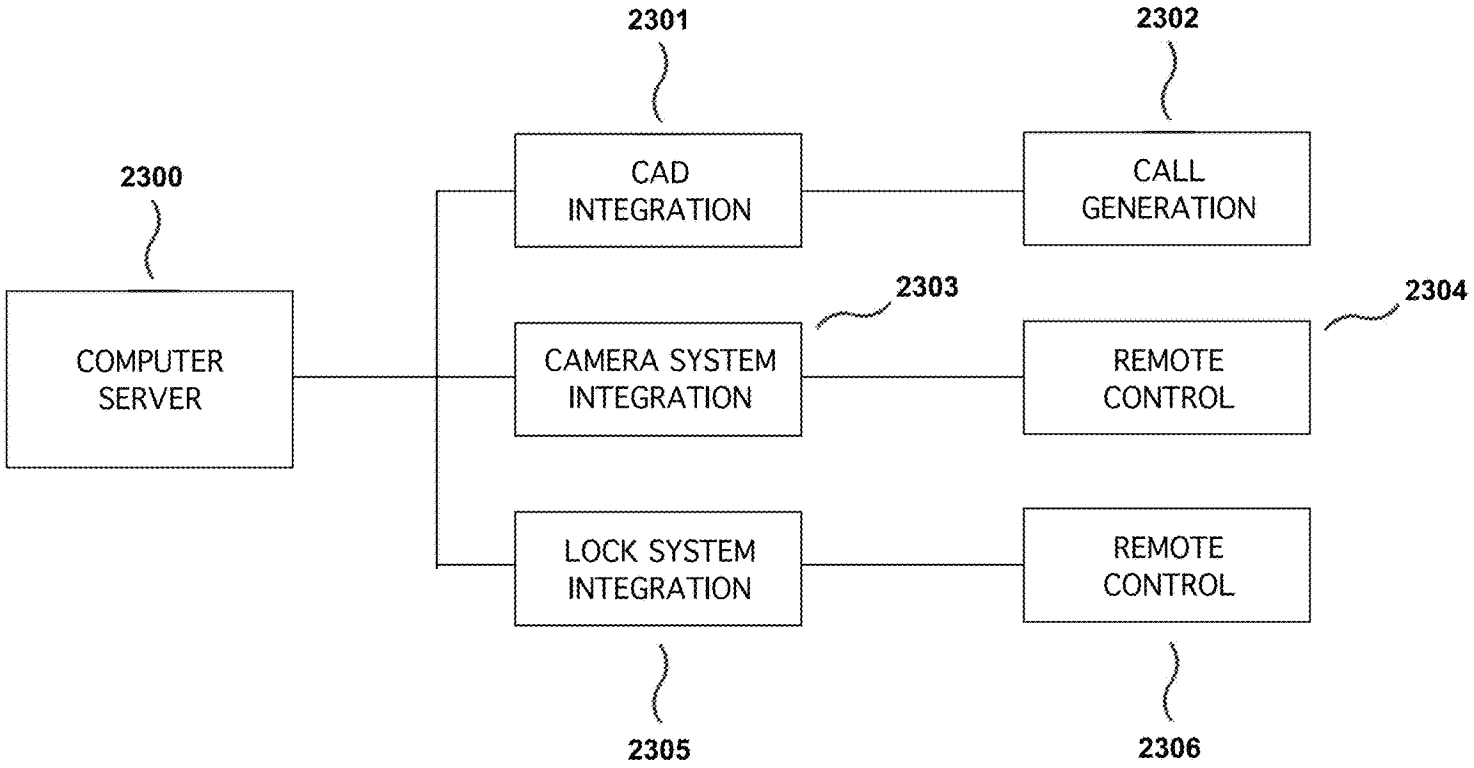
FIG. 23 is a flowchart illustration showing capabilities of computer server(s) herein to integrate with external hardware and software platforms, consistent with aspects related to the innovations herein.

FIG. 23 is a flowchart illustration showing the ability of an exemplary computer server to integrate with external hardware and software platforms. External hardware and software platforms that can be configured to function cooperatively with implementations herein are, but not limited to: computer aided dispatch systems (CAD) 2301, surveillance camera systems 2303, and electronically controlled lock systems 2305.

CAD system integration 2301 enables implementations to automatically generate a call for service 2302 through the integrated CAD system when the detection of an event is processed (FIG. 01).

Surveillance camera system integration 2303 enables users of the implementations herein to view and control 2304 integrated camera systems from the any of the public safety user interfaces configured with access and control permissions FIG. 01, 0108, 0109, 0110).

Electronically controlled lock system integration 2305 enables users of the implementations herein to view the status of and control 2306, integrated, electronically controlled lock systems from the any of the public safety user interfaces configured with access and control permissions (FIG. 01, 0108, 0109, 0110).

Figure 24:
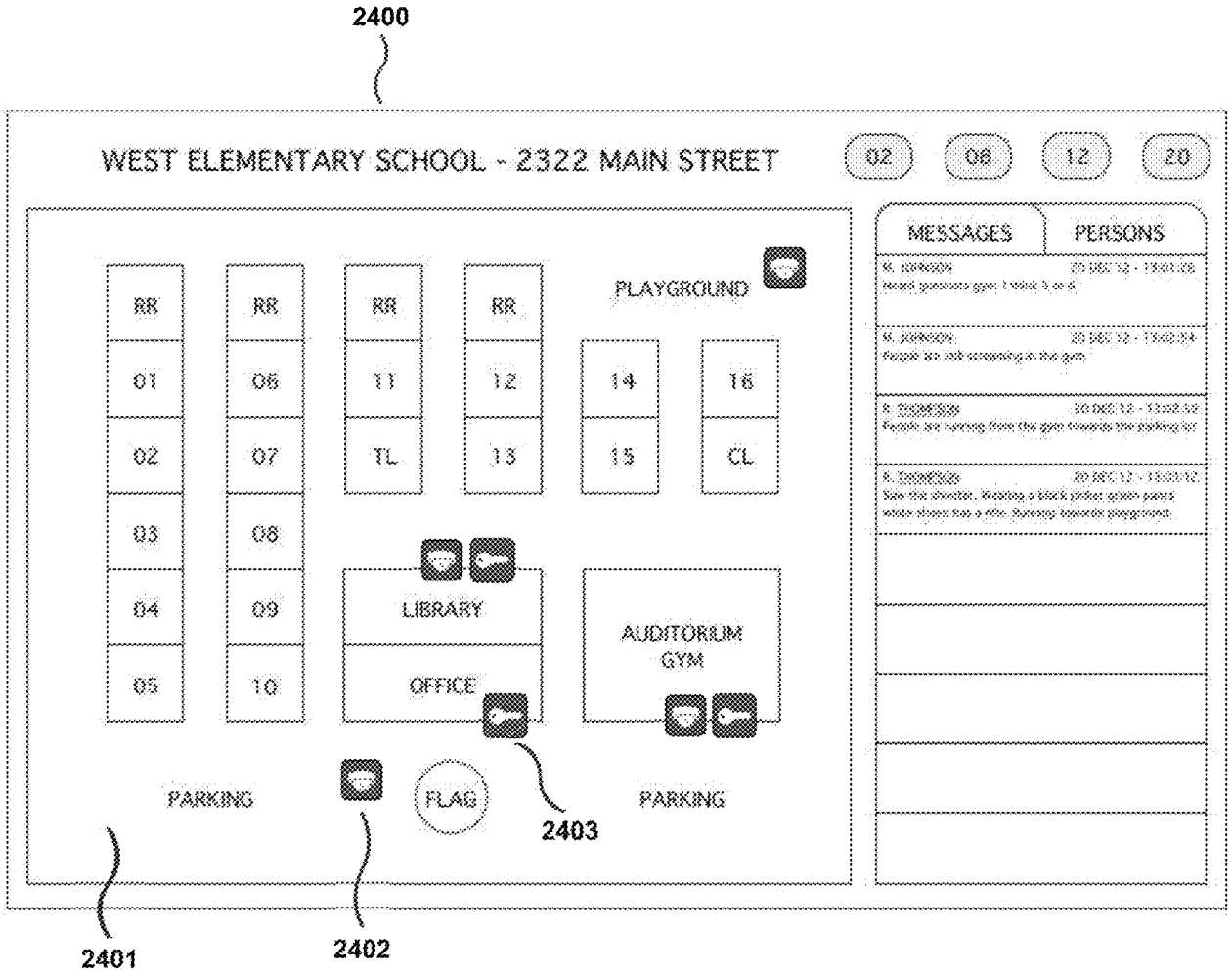
FIG. 24 is an illustration showing an exemplary public safety user interface and the ability to access and control integrated, external hardware and software platforms, consistent with aspects related to the innovations herein.

FIG. 24 is an illustration showing an embodiment of one of an exemplary public safety user interfaces 2400 (FIG. 01, 0108, 0109, 0110) displaying icons on the map component 2401. The icons allow the users to access and control integrated external hardware and software platforms. Using a computer cursor, "clicking" or "double-clicking" (depending on system configuration) a computer mouse button while placed upon an icon such as a camera system icon 2402 or a lock control system icon 2403, enables the user to access and control the respective integrated system.

Figure 25:
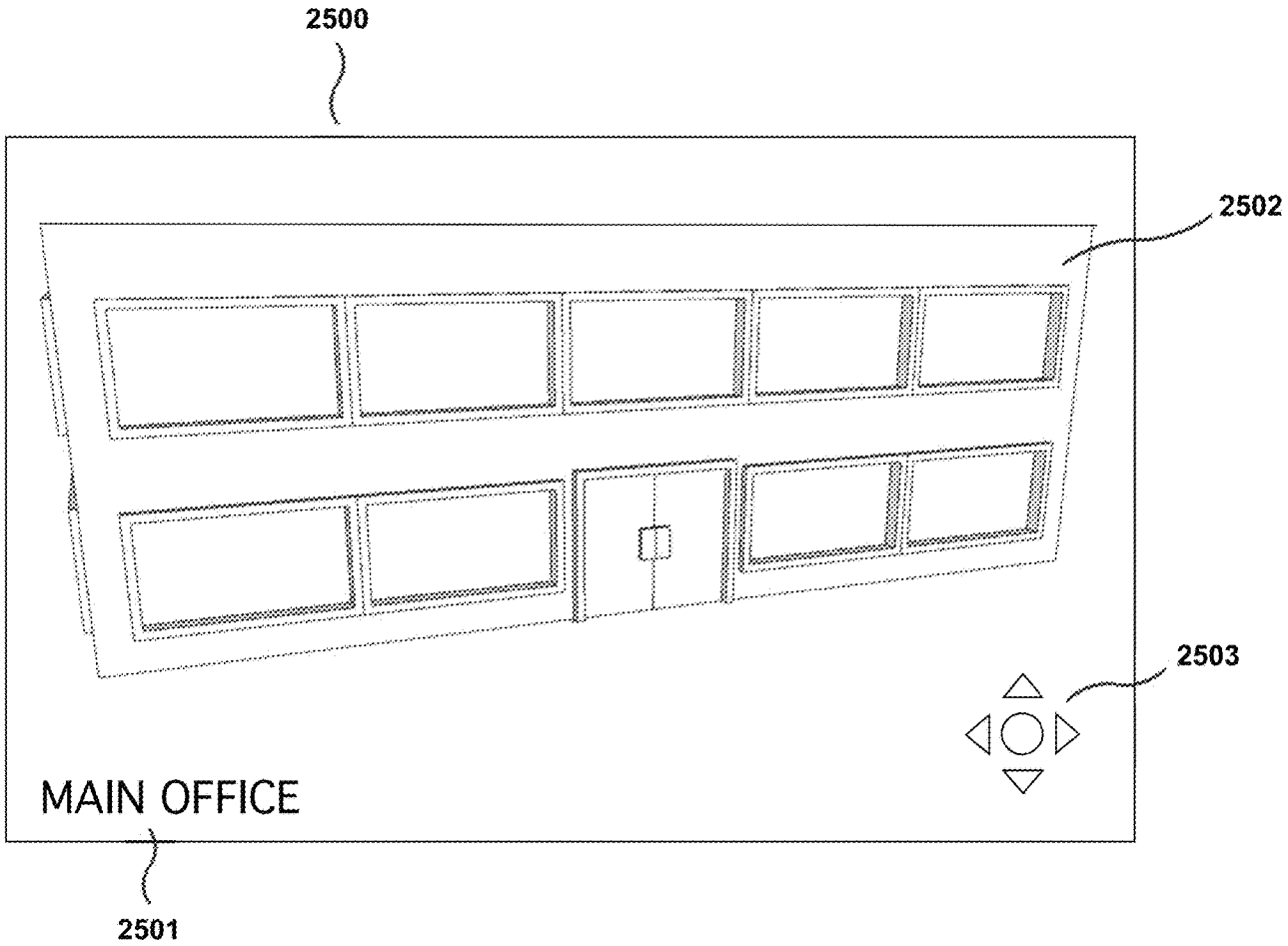
FIG. 25 is an illustration showing an exemplary pop-up window generated from the public safety user interface enabling the user to view an integrated video feed, consistent with aspects related to the innovations herein.

FIG. 25 is an illustration showing an embodiment a pop-up computer interface window 2500 that is generated when a user accesses an integrated surveillance camera system from one of the exemplary public safety user interfaces 2400 (see FIG. 01, 0108, 0109, 0110) using the process described herein. The pop-up computer window used to control components of an integrated surveillance camera system is comprised of, but not limited to the following elements: a name or description of the camera feed being viewed 2501, a view of the live camera feed 2502, and on-screen camera controls 2503 that provide the ability to remotely control cameras that are capable of pan, tilt, and zoom functionality.

Figure 26:
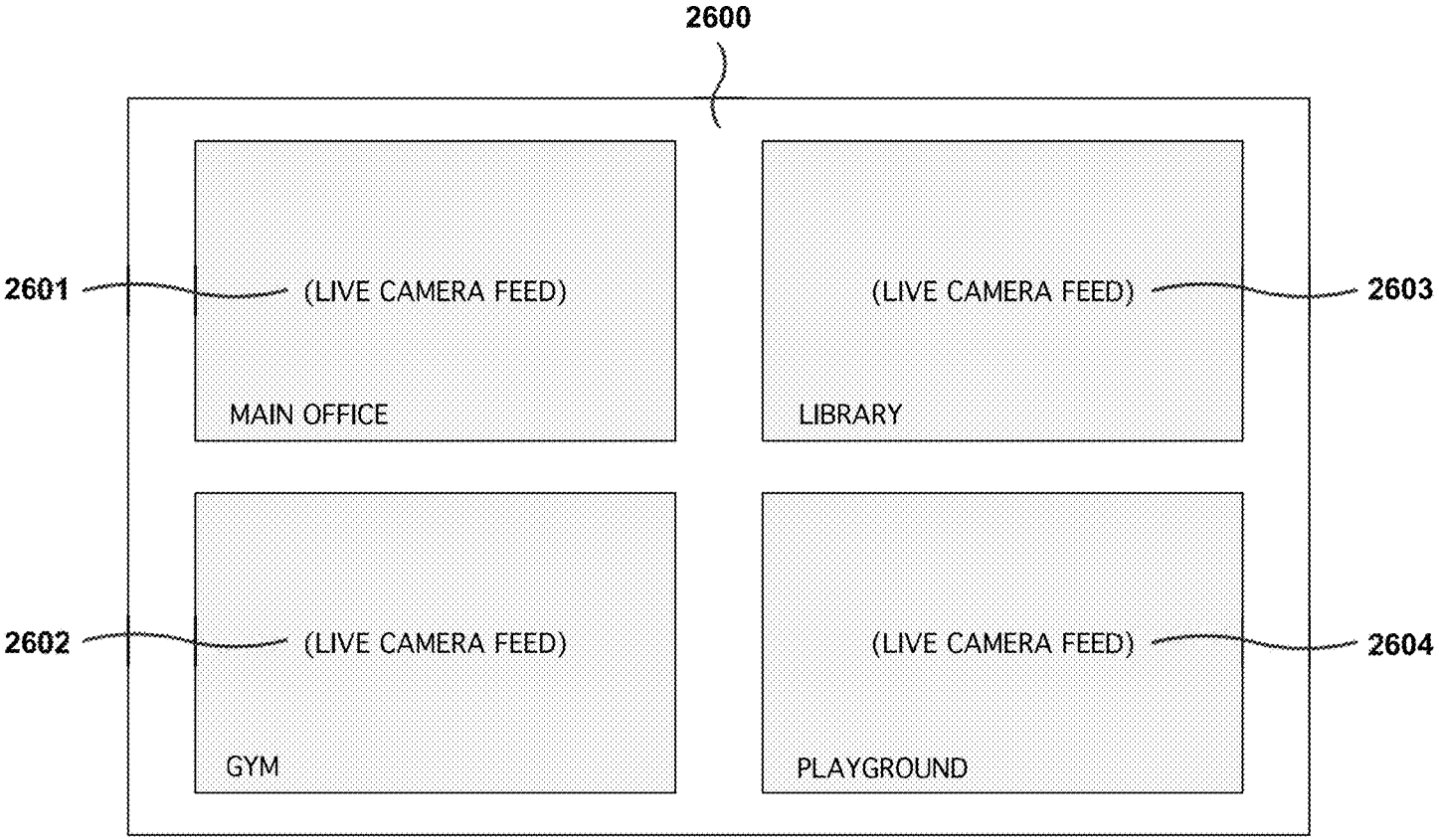
FIG. 26 is an illustration showing an exemplary pop-up window generated from the public safety user interface enabling the user to view multiple, integrated video feeds, consistent with aspects related to the innovations herein.

FIG. 26 is an illustration showing an embodiment a pop-up computer interface window 2600 that is generated when a user accesses an integrated surveillance camera system from one of the exemplary public safety user interfaces 2400 (see FIG. 01, 0108, 0109, 0110). This pop-up computer interface window can be accessed using, but not limited to: a user interface drop-down menu, designated keyboard buttons (i.e. control+F5) or on-screen command buttons and displays the live-feed from all surveillance cameras integrated to function with implementations herein 2601-2604.

Figure 27:
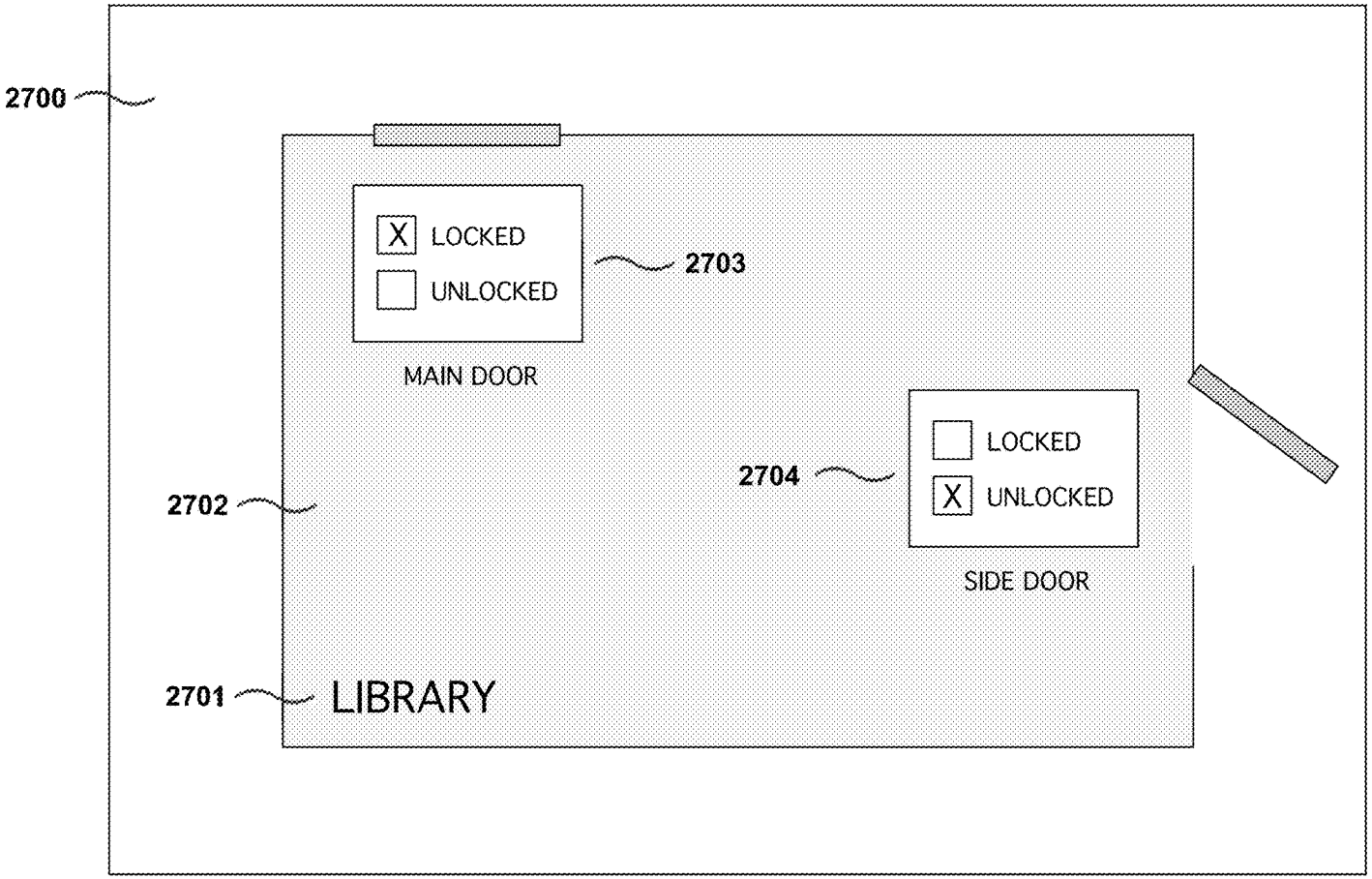
FIG. 27 is an illustration showing an exemplary pop-up window generated from the public safety user interface enabling the user to lock, unlock, and view the status of electronic lock mechanisms integrated to function with the present implementations, consistent with aspects related to the innovations herein.

FIG. 27 is an illustration showing an embodiment a pop-up computer interface window 2700 that is generated when a user accesses an integrated electronic lock control system from one of the public safety user interfaces 2400 (see FIG. 01, 0108, 0109, 0110) using the process described herein. The pop-up computer window used to control components of an integrated electronic lock control system is comprised of, but not limited to the following elements: a name or description of the lock or locks being controlled 2701, a visual depiction of the location where the controlled lock or locks are located 2702, and on-screen controls capable of viewing the status of (locked or unlocked) and remotely locking or unlocking lock-mechanisms integrated to function with implementations herein 2703, 2704.

Some implementations herein may also bear relation to U.S. application Ser. No. 14/231,604, filed Mar. 31, 2014, published as US2014/0327543A1, which are incorporated herein by reference in entirety.

As disclosed herein, implementations and features of the present inventions may be implemented through computer-hardware, software and/or firmware. For example, the systems and methods disclosed herein may be embodied in various forms including, for example, a data processor, such as a computer that also includes a database, digital electronic circuitry, firmware, software, or in combinations of them. Further, while some of the disclosed implementations describe specific (e.g., hardware, etc.) components, systems and methods consistent with the innovations herein may be implemented with any combination of hardware, software and/or firmware. Moreover, the above-noted features and other aspects and principles of the innovations herein may be implemented in various environments. Such environments and related applications may be specially constructed for performing the various processes and operations according to the inventions or they may include a general-purpose computer or computing platform selectively activated or reconfigured by code to provide the necessary functionality. The processes disclosed herein are not inherently related to any particular computer, network, architecture, environment, or other apparatus, and may be implemented by a suitable combination of hardware, software, and/or firmware. For example, various general-purpose machines may be used with programs written in accordance with teachings of the inventions, or it may be more convenient to construct a specialized apparatus or system to perform the required methods and techniques.

In the present description, the terms component, module, device, etc. may refer to any type of logical or functional device, process or blocks that may be implemented in a variety of ways. For example, the functions of various blocks can be combined with one another into any other number of modules. Each module can be implemented as a software program stored on a tangible memory (e.g., random access memory, read only memory, CD-ROM memory, hard disk drive) within or associated with the computing elements, sensors, receivers, etc. disclosed above, e.g., to be read by a processing unit to implement the functions of the innovations herein. Also, the modules can be implemented as hardware logic circuitry implementing the functions encompassed by the innovations herein. Finally, the modules can be implemented using special purpose instructions (SIM© instructions), field programmable logic arrays or any mix thereof which provides the desired level performance and cost.

Aspects of the systems and methods described herein may be implemented as functionality programmed into any of a variety of circuitry, including programmable logic devices ("PLDs"), such as field programmable gate arrays ("FPGAs"), programmable array logic ("PAL") devices, electrically programmable logic and memory devices and standard cell-based devices, as well as application specific integrated circuits. Some other possibilities for implementing aspects include: memory devices, microcontrollers with memory (such as EEPROM), embedded microprocessors, firmware, software, etc. Furthermore, aspects may be embodied in microprocessors having software-based circuit emulation, discrete logic (sequential and combinatorial), custom devices, fuzzy (neural) logic, quantum devices, and hybrids of any of the above device types. The underlying device technologies may be provided in a variety of component types, e.g., metal-oxide semiconductor field-effect transistor ("MOSFET") technologies like complementary metal-oxide semiconductor ("CMOS"), bipolar technologies like emitter-coupled logic ("ECL"), polymer technologies (e.g., silicon-conjugated polymer and metal-conjugated polymer-metal structures), mixed analog and digital, and so on.

It should also be noted that various logic and/or features disclosed herein may be enabled using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, non-volatile storage media in tangible various forms (e.g., optical, magnetic or semiconductor storage media), though do not encompass transitory media.

Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Other implementations of the inventions will be apparent to those skilled in the art from consideration of the specification and practice of the innovations disclosed herein. It is intended that the specification and examples be considered as exemplary only, with a true scope and spirit of the inventions being indicated by the present disclosure and various associated principles of related patent doctrine.

The invention claimed is:

1. A method of performing processing associated with emergency notifications, the method compromising:

detecting a malicious even within a predetermined area of a site by a sensor of a gunshot location system;

processing the malicious event as a function of criteria associated with information regarding the malicious event, the sensor and/or the gunshot location system;

alerting at least one computer configured to monitor and respond to the malicious event, a public safety dispatch center, and at least one wireless device regarding the malicious event based on the processing of the malicious event; and processing communications among the at least one computer configured to monitor and respond to the malicious event, the public safety dispatch center, and the least one wireless device to coordinate response to the malicious event.

2. The method of claim 1, wherein wireless device is or includes a site- based wireless device.

3. The method of claim 1, further comprising alerting at least one of a first responder wireless device and/or public safety wireless device.

4. The method of claim 1, wherein the alerting of the malicious event includes one or more of a type of alert, a description of a location of the site, address of the site, a map of the site, status indicators of a wireless device, messages and/or site-based user information.

5. The method of claim 1, further comprising:

transmitting location information to a server in response to receiving the alert;

transmitting an alert acknowledgment to the server within a predetermined time period; and transmitting emergency instructions in response to receiving the alert acknowledgment.

6. The method of claim 3, wherein the alerting of the malicious event includes a location within the site of at least one site-based user and/or a status of the at least one site-based user.

7. The method of claim 4, wherein the malicious event is displayed with augmented indicia such as visual highlighting applied to the location of the malicious event.

8. The method of claim 7, wherein a chronological order for a plurality of malicious events is graphically represented.

9. The method of claim 6, where in chronological order for a plurality of malicious events is represented via lines of increasing thickness representing the location of the malicious events.

10. The method of claim 4, further comprising:

providing the messages for display chronologically on a site-based wireless device user interface.

11. A method of performing processing associated with emergency notifications, the method comprising:

providing or processing information regarding a facility;

providing a display that locates rooms within the facility in which shots have been detected as fired; and determining location of a path of an active shooter and location of an active shooter based on processing information regarding the shots fired as received from sensors, the information including time and location data of the shots fired.

12. The method of claim 11, further comprising:

providing location data regarding a room-by-room sequence of movement based on the detected shots, the location data being configured to provide position of the shooter of shots for display on a map-based user interface.

13. The method of claim 4, wherein the alerting of the malicious event includes a location within the site of at least one site-based user and/or a status of the at least one site-based user.

14. The method of claim 13, wherein the malicious event is displayed with augmented indicia such as visual highlighting applied to the location of the malicious event.

15. The method of claim 13, wherein a chronological order for a plurality of malicious events is graphically represented, such as via arrows.

16. The mettlod of claim 13, further comprising:

providing the messages for display chronologically on a site-based wireless device user interface.

17. The method of claim 13, processing information for communication with the mass notification system, the information including instructions regarding a SMS messages, a light and/or an alarm/siren.

18. The method of claim 8, wherein the graphical representation of the chronological order comprises arrows.

19. The method of claim 11 wherein the information regarding a facility includes detailed floor plans of the facility.

20. A method of performing processing associated with emergency notifications, the method comprising:

upon detection of a malicious event at a facility, alerting first entities comprising at least one computer configured to monitor and respond to the malicious event, a public safety dispatch center, and at least one wireless device;

sharing, via one or more software applications, coordinated information between two or more second entities, the second entities comprising at least one of a monitoring service provider, a facility security command center, the public safety dispatch center, and/or an emergency responder; and initiating and/or adjusting, via the shared information, a coordinated tactical response to locate, contain and/or eliminate a threat associated with the malicious event.

21. The method of claim 20, further comprising processing information for communication with a mass notification system, the information including instructions regarding a SMS message, a light, and/or an alarm or siren.

22. The method of claim 20, further comprising displaying the malicious event on one or more mobile devices associated with the first entities and/or the second entities.

23. The method of claim 22, wherein the malicious event is displayed with augmented indicia such as visual highlighting applied to the location of the malicious event.

24. The method of claim 22, wherein a chronological order for a plurality of malicious events is graphically represented.

25. The method of claim 22, further comprising:

providing messages for display chronologically on a site-based wireless device user interface.

26. The method of claim 22, further comprising processing information for communication with a mass notification system, the information including instructions regarding a SMS messages, a light, and/or an alarm or siren.

* * * * *